US009409701B2

(12) United States Patent
Baker et al.

(10) Patent No.: US 9,409,701 B2
(45) Date of Patent: Aug. 9, 2016

(54) METHOD OF CUSTOM FITTING AN ARTICLE OF FOOTWEAR AND APPARATUS INCLUDING A CONTAINER

(71) Applicant: NIKE, Inc., Beaverton, OR (US)

(72) Inventors: Brian D. Baker, Portland, OR (US); Alexandre Baudouin, Portland, OR (US); William M. Dieter, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/642,874

(22) Filed: Mar. 10, 2015

(65) Prior Publication Data

US 2015/0175343 A1 Jun. 25, 2015

Related U.S. Application Data

(62) Division of application No. 13/895,471, filed on May 16, 2013, now Pat. No. 8,997,291, which is a division of application No. 13/307,220, filed on Nov. 30, 2011, now Pat. No. 8,595,877, which is a division of (Continued)

(51) Int. Cl.

| | |
|---|---|
| ***A43D 3/00*** | (2006.01) |
| ***B65D 85/18*** | (2006.01) |
| ***A43D 95/12*** | (2006.01) |
| ***B65D 5/42*** | (2006.01) |

(Continued)

(52) U.S. Cl.

CPC ..... *B65D 85/187* (2013.01); *A43D 63/00* (2013.01); *A43D 95/12* (2013.01); *B65D 5/4295* (2013.01); *F22B 1/284* (2013.01); *B65D 2205/02* (2013.01)

(58) Field of Classification Search

CPC ..... A43D 3/00; H05B 6/64

USPC ..... 206/223, 216, 278; 12/1 F, 1 R, 142 P, 12/142 R, 142 G, 142 T

See application file for complete search history.

(56) References Cited

U.S. PATENT DOCUMENTS

| | | | |
|---|---|---|---|
| 1,132,645 | A | 3/1915 | Andrerson |
| 1,377,809 | A | 5/1921 | Crosier |
| 1,540,974 | A | 6/1925 | Wilson |

(Continued)

FOREIGN PATENT DOCUMENTS

| | | | |
|---|---|---|---|
| CN | 200973696 | Y | 11/2007 |
| DE | 19825615 | C1 | 7/1999 |

(Continued)

OTHER PUBLICATIONS

International Preliminary Report on Patentability (including Written Opinion of the ISA) for Application No. PCT/US2010/049085, mailed on Mar. 29, 2012.

(Continued)

*Primary Examiner* — Anthony Stashick
*Assistant Examiner* — Raven Collins
(74) *Attorney, Agent, or Firm* — Plumsea Law Group, LLC

(57) ABSTRACT

A method and kit for custom fitting an article of footwear is disclosed. A container holding the article of footwear includes a steaming apparatus that allows a customer to subject the article of footwear to steam. The article of footwear is placed within the steaming apparatus to subject the article of footwear to steam. The method can include cooling the article of footwear on the customer's foot to custom fit the article of footwear.

18 Claims, 29 Drawing Sheets

Related U.S. Application Data application No. 13/183,727, filed on Jul. 15, 2011, now Pat. No. 8,136,190, which is a division of application No. 12/562,904, filed on Sep. 18, 2009, now Pat. No. 8,033,393.

(51) Int. Cl.
*F22B 1/28* (2006.01)
*A43D 63/00* (2006.01)

(56) References Cited

U.S. PATENT DOCUMENTS

| | | | | |
|---|---|---|---|---|
| 1,888,375 | A | 11/1932 | Diener | |
| 1,897,274 | A | 2/1933 | Oswald | |
| 2,275,334 | A | 3/1942 | Young | |
| 2,771,986 | A | 11/1956 | Bekoff | |
| 2,817,466 | A | 12/1957 | Bonjokian | |
| 2,929,082 | A | 3/1960 | Schultz | |
| 3,007,183 | A | 11/1961 | Kamborian et al. | |
| 3,207,357 | A | 9/1965 | Schmitt | |
| 3,360,112 | A | 12/1967 | Johnson | |
| 3,474,476 | A | 10/1969 | Forma | |
| 3,483,577 | A | 12/1969 | Schultz | |
| 3,535,418 | A | 10/1970 | Daum et al. | |
| 3,611,501 | A | 10/1971 | Daum et al. | |
| 3,720,971 | A | 3/1973 | Wyness et al. | |
| 3,848,287 | A | 11/1974 | Simonsen | |
| 4,541,360 | A | 9/1985 | Higgins et al. | |
| 4,621,384 | A | 11/1986 | Walega | |
| 4,662,017 | A | 5/1987 | Gruber | |
| 4,901,390 | A | 2/1990 | Daley | |
| 4,964,229 | A | 10/1990 | Laberge | |
| 5,003,708 | A | 4/1991 | Daley | |
| 5,083,910 | A | 1/1992 | Abshire et al. | |
| 5,123,180 | A | 6/1992 | Nannig et al. | |
| 5,193,675 | A * | 3/1993 | Otis | A45C 3/12 190/16 |
| 5,284,632 | A | 2/1994 | Kudla et al. | |
| 5,509,170 | A | 4/1996 | LoFaro et al. | |
| 5,692,315 | A | 12/1997 | Sham | |
| 5,714,098 | A | 2/1998 | Potter | |
| 5,733,647 | A | 3/1998 | Moore, III et al. | |
| 5,746,015 | A | 5/1998 | Clement et al. | |
| 5,797,862 | A | 8/1998 | Lamont | |
| 5,879,725 | A | 3/1999 | Potter | |
| 5,882,612 | A | 3/1999 | Riley | |
| 5,885,622 | A | 3/1999 | Daley | |
| 5,979,749 | A | 11/1999 | Bozich | |
| 6,026,595 | A | 2/2000 | Curry | |
| 6,247,250 | B1 | 6/2001 | Hauser | |
| 6,345,148 | B1 | 2/2002 | Chang | |
| 6,346,210 | B1 | 2/2002 | Swartz et al. | |
| 6,455,084 | B2 | 9/2002 | Johns | |
| 6,505,742 | B2 | 1/2003 | Cagner | |
| 6,634,499 | B2 | 10/2003 | Allen et al. | |
| 6,703,142 | B2 | 3/2004 | Snow | |
| 7,008,386 | B2 | 3/2006 | Alaimo et al. | |
| 7,257,907 | B2 | 8/2007 | Green | |
| 7,309,472 | B2 | 12/2007 | Michaelson et al. | |
| 7,458,173 | B2 | 12/2008 | Kielt et al. | |
| D584,053 | S | 1/2009 | Abdo et al. | |
| 7,802,380 | B2 | 9/2010 | Riebesell | |
| 8,033,393 | B2 | 10/2011 | Baker et al. | |
| 8,070,006 | B2 * | 12/2011 | Austin | B65F 1/004 220/4.28 |
| 8,136,190 | B2 | 3/2012 | Baker et al. | |
| 8,595,877 | B2 | 12/2013 | Baker et al. | |
| 2002/0050080 | A1 | 5/2002 | Vasyli | |
| 2004/0031169 | A1 | 2/2004 | Jensen et al. | |
| 2004/0069149 | A1 | 4/2004 | Wakefield | |
| 2004/0188285 | A1 | 9/2004 | Yoshikawa | |
| 2004/0194348 | A1 | 10/2004 | Campbell et al. | |
| 2004/0194352 | A1 | 10/2004 | Campbell et al. | |
| 2005/0262757 | A1 | 12/2005 | Wong et al. | |
| 2006/0049181 | A1 | 3/2006 | Tuhkru et al. | |
| 2007/0039840 | A1 | 2/2007 | Mu et al. | |
| 2008/0034616 | A1 | 2/2008 | Rhenter | |
| 2008/0087563 | A1 | 4/2008 | Kim | |
| 2008/0093257 | A1 * | 4/2008 | Kim | B65D 5/4204 206/769 |
| 2009/0044426 | A1 | 2/2009 | Levine | |
| 2011/0068024 | A1 | 3/2011 | Baker et al. | |
| 2011/0266173 | A1 | 11/2011 | Baker et al. | |
| 2012/0077136 | A1 | 3/2012 | Baker et al. | |
| 2013/0322859 | A1 | 12/2013 | Baker et al. | |

FOREIGN PATENT DOCUMENTS

| | | | |
|---|---|---|---|
| DE | 10120089 | A1 | 10/2002 |
| FR | 2564428 | A3 | 11/1985 |
| GB | 2344046 | A | 5/2000 |
| JP | 2005021647 | A | 1/2005 |
| SU | 389776 | A1 | 7/1973 |

OTHER PUBLICATIONS

International Search Report and Written Opinion for Application No. PCT/US2010/049085, mailed on May 9, 2011.
Invitation to Pay Additional Fees and Where Applicable Protest Fee for Application No. PCT/US2010/049085, mailed Feb. 22, 2011.

* cited by examiner

METHOD OF CUSTOM FITTING AN ARTICLE OF FOOTWEAR AND APPARATUS INCLUDING A CONTAINER

CROSS-REFERENCE TO RELATED APPLICATIONS

This application is a division of U.S. application Ser. No. 13/895,471, entitled "Method of Custom Fitting an Article of Footwear and Apparatus Including a Container", now U.S. Pat. No. 8,997,291, filed on May 16, 2013 and issued on Apr. 7, 2015, which application is a division of U.S. application Ser. No. 13/307,220, entitled "Method of Custom Fitting an Article of Footwear and Apparatus Including a Container", now U.S. Pat. No. 8,595,877, filed on Nov. 30, 2011 and issued on Dec. 3, 2013, which application is a division of U.S. application Ser. No. 13/183,727, entitled "Method of Custom Fitting an Article of Footwear and Apparatus Including a Container", now U.S. Pat. No. 8,136,190, filed on Jul. 15, 2011 and issued on Mar. 20, 2012, which application is a division of U.S. application Ser. No. 12/562,904, entitled "Method of Custom Fitting an Article of Footwear and Apparatus Including a Container", now U.S. Pat. No. 8,033,393, filed on Sep. 18, 2009 and issued on Oct. 11, 2011, the disclosures of all of which applications are hereby incorporated by reference in their entirety.

BACKGROUND

The present invention relates to a system and method of custom fitting articles, and in particular to a post-manufacturing customization system and method of custom fitting an article of footwear.

Methods of heating an article of footwear to mold one or more portions of the article of footwear have been previously proposed. Tuhkru et al. (U.S. Patent Application Publication Number 2006/0049181) teaches a system for breaking in leather shoes. Tuhkru teaches a system that uses two bags filled with sea salt, gravel or other material that can hold heat that are heated in a microwave for several minutes. Tuhkru teaches that the bags are then placed inside of the shoes and the shoes containing the bags are then placed in a heat conservation bag. The process is completed by cooling the heated shoes on the foot.

Other systems and methods of molding an article of footwear to a wearer's foot have been proposed. Typically, other systems rely on a combination of heat and an applied vacuum to mold the article of footwear to the wearer's foot. The vacuum is used to apply an outside force to the article of footwear. The outside force from the vacuum presses the footwear against the wearer's foot and molds the footwear to the shape of the foot. However, these types of systems require use of a vacuum or some other apparatus to create pressure on the outside of the footwear. Thus, additional equipment not included in the container with the article of footwear must be purchased or obtained to mold the article of footwear to wearer's foot.

SUMMARY OF THE INVENTION

A method of custom fitting an article of footwear and an apparatus for custom fitting an article of footwear are disclosed. In one aspect, the invention provides a container for holding an article of footwear that can be configured as a steam tent.

In another aspect, the invention provides a container lid comprising: a bottom portion containing holes; a first movable support; a second movable support; and a cover material disposed between the first and second movable supports to configure the container lid into a steam tent.

In another aspect, the invention provides a kit for custom fitting an article of footwear comprising: a container; an article of footwear; and a steam tent attached to a lid of the container.

In another aspect, the invention provides a method of custom fitting an article of footwear, the method comprising: deploying a steam tent associated with a container lid; placing an article of footwear into the steam tent; and subjecting the steam tent containing the article of footwear to a source of steam.

In another aspect, the invention provides a kit for custom fitting an article of footwear comprising: a container; and a steam tray sized and dimensioned to receive an article of footwear.

In another aspect, the invention provides a method of custom fitting an article of footwear, the method comprising: removing a steam tray from inside a container for holding an article of footwear; placing an article of footwear into the steam tray; and subjecting the steam tray containing the article of footwear to a source of steam.

In another aspect, the invention provides a container lid having a predetermined removable area sized and dimensioned to fit a portion of an article of footwear.

In another aspect, the invention provides a kit for custom fitting an article of footwear comprising: a container having a predetermined removable area sized and dimensioned to fit a portion of an article of footwear; and an article of footwear.

In another aspect, the invention provides a method of custom fitting an article of footwear, the method comprising: forming a hole sized and dimensioned to fit a portion of an article of footwear in a container; placing a portion of an article of footwear in contact with the hole; and subjecting the hole to a source of steam.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Generally, a post-manufacturing customization system and method of custom fitting an article of footwear may be configured by providing a customer with an apparatus for steaming an article of footwear with the article of footwear in a container.

Figure 1:
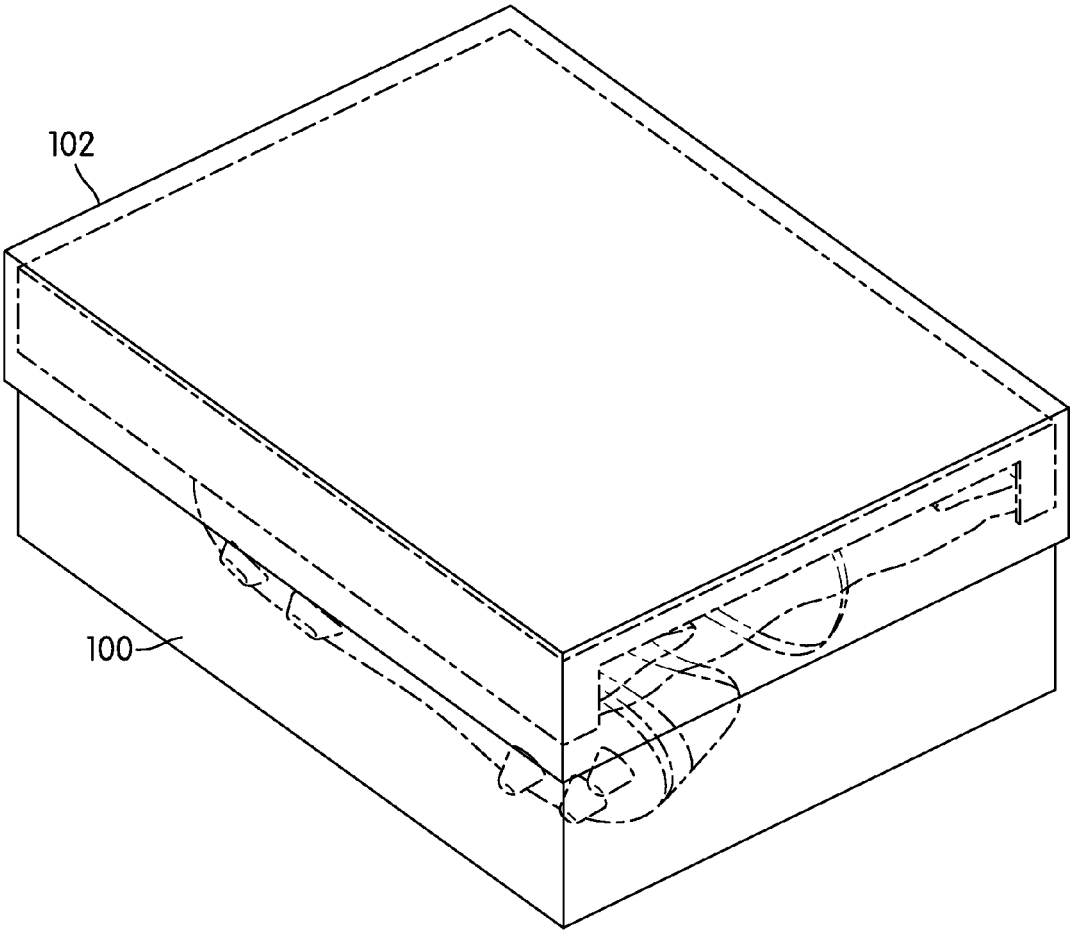
FIG. 1 is an isometric view of an exemplary embodiment of a container including a steam tent.

FIG. 1 is a view of an embodiment of a container 100 that is configured to receive an article of footwear. In some cases, the container may be a box with a detachable lid. In other cases, the container may be a box with a hinged lid. In one exemplary embodiment, article of footwear may be a shoe. However, in other embodiments, article of footwear could be any type of footwear, including, but not limited to: a running shoe, a basketball shoe, a high heel shoe, a boot, a slip-on shoe, a low top shoe, as well as other types of footwear. Additionally, while a single article of footwear is shown in the current embodiment, the same principles taught in this detailed description could be applied to a second, complementary article of footwear.

Figure 2:
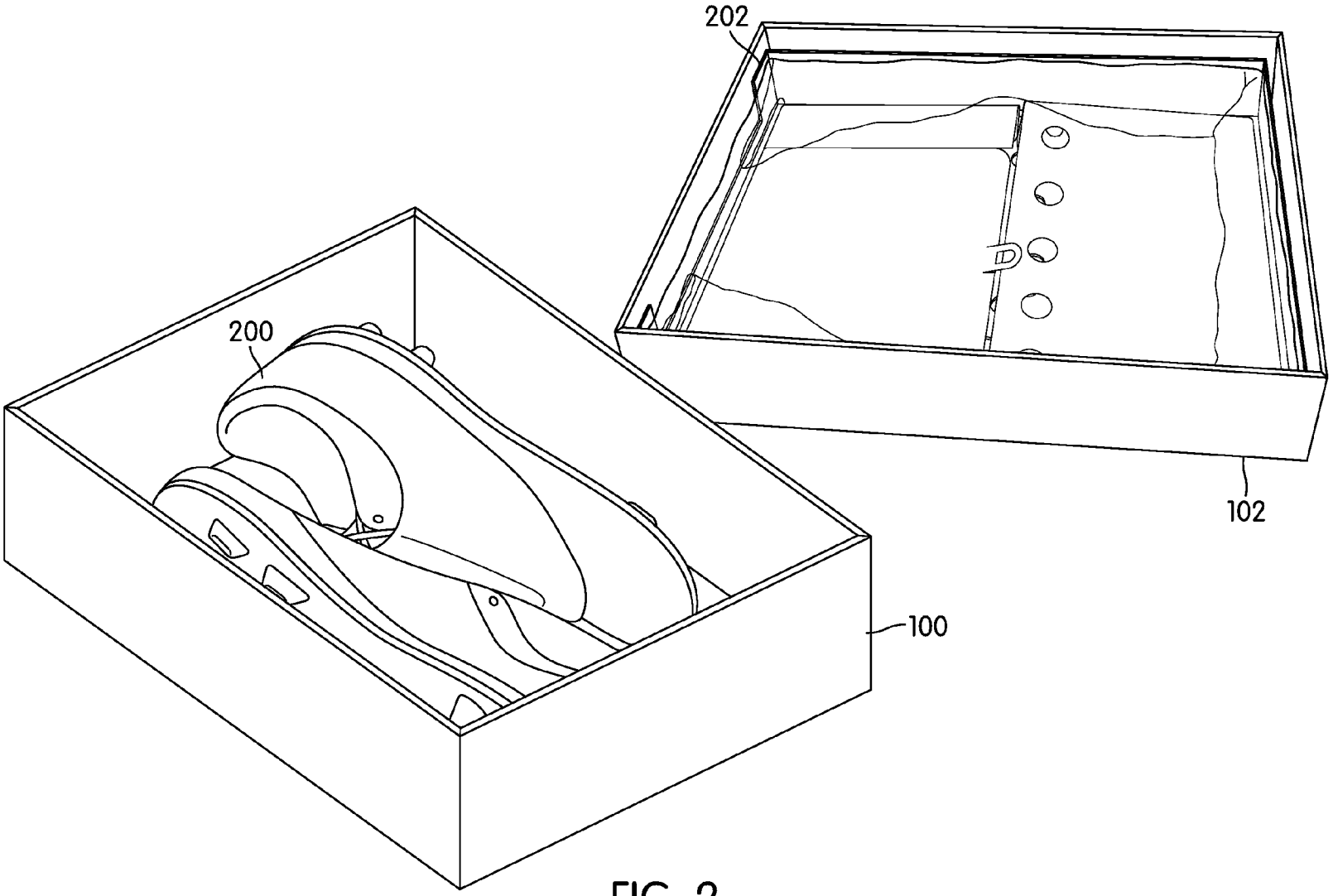
FIG. 2 is an isometric view of an embodiment of an opened container with a lid containing a steam tent.

Referring to FIGS. 1 and 2, an apparatus for steaming an article of footwear may be provided within a container 100 holding the article of footwear. In this embodiment, container 100 includes a detachable lid 102. In different embodiments, the apparatus for steaming an article of footwear may be provided in a container in various ways. In some embodiments, the apparatus for steaming an article of footwear is provided attached to a lid of the container. In a different embodiment, the apparatus for steaming an article of footwear may be provided separately in the container.

Referring to FIG. 2, an apparatus for steaming an article of footwear 200 may be attached to a lid 102 of a container 100 for holding an article of footwear 200. Container 100 holds article of footwear 200 and a steaming apparatus. In this embodiment, steaming apparatus is a steam tent 202 that can be attached to the container lid 102.

Figure 3:
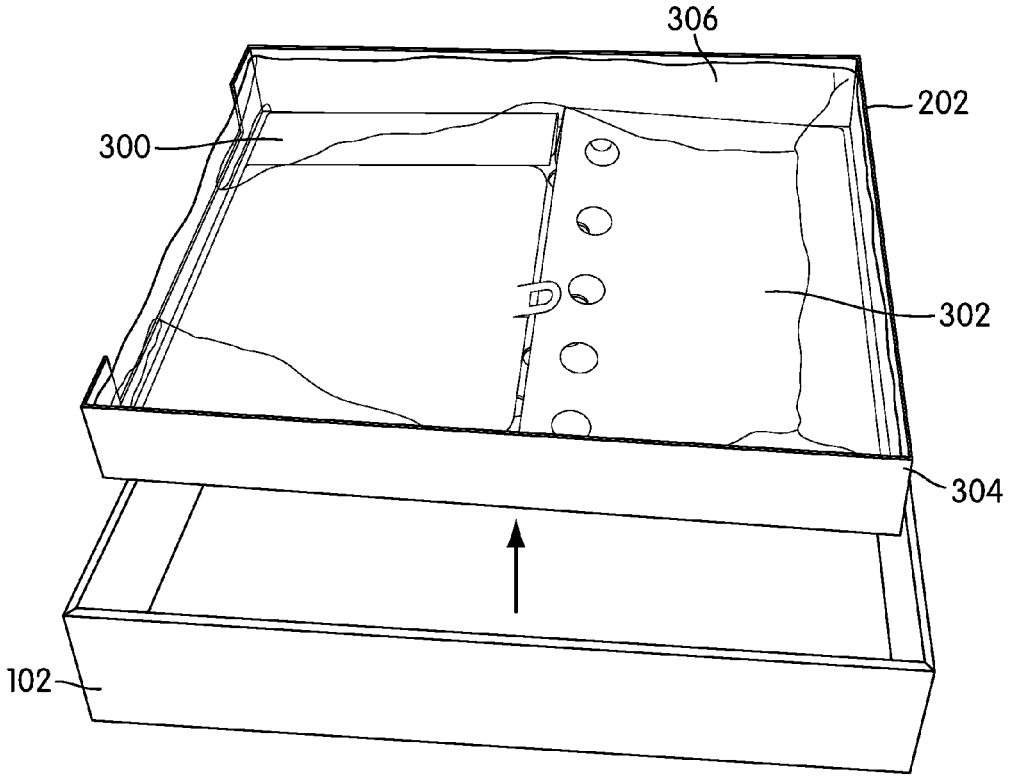
FIG. 3 is an isometric view of an embodiment of a lid containing a steam tent.

FIG. 3 illustrates an exemplary embodiment of a steaming apparatus where steaming apparatus is a steam tent. Referring to FIG. 3, steam tent 202 is shown in a non-deployed position folded inside lid 102. In one embodiment, steam tent 202 can include a bottom portion 304 arranged with holes, at least two movable supports 300, 302 and a cover material 306. In one exemplary embodiment, cover material 306 is plastic sheeting. In different embodiments, cover material may be any material configured to envelop an article of footwear in a steam environment. Cover material may include, but is not limited to: plastic sheeting, metallic film, synthetic material, cloth, as well as other types of materials. In addition, in some cases, cover material may be transparent or semi-transparent. In other cases, cover material may be opaque or nontransparent.

Figure 4:
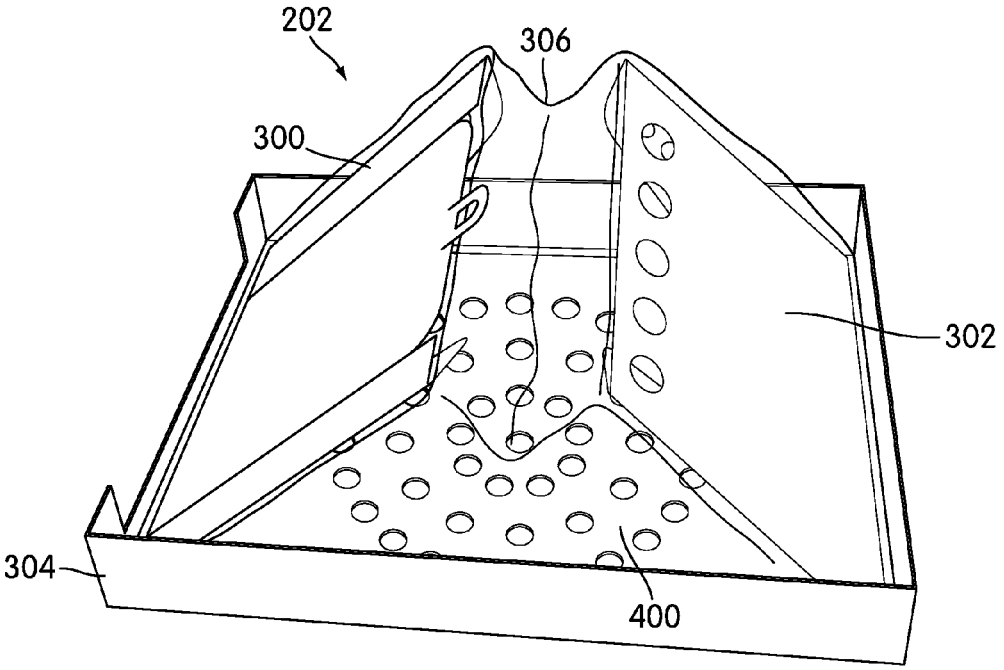
FIG. 4 is an isometric view of an embodiment of a steam tent partially deployed.

Referring to FIG. 4, steam tent 202 is illustrated in a partially deployed position. In this embodiment, steam tent 202 includes a left movable support 300 and a right movable support 302. In other embodiments, steam tent can include two or more movable supports. Right movable support 302 and left movable support 300 are raised from a non-use position. Cover material 306 can be attached to bottom portion 304 and disposed over right movable support 302 and left movable support 300. Bottom portion 304 of steam tent 202 is provided with holes 400 for allowing steam to enter into steam tent 202 and subject article of footwear 200 to a steam environment.

Figure 5:
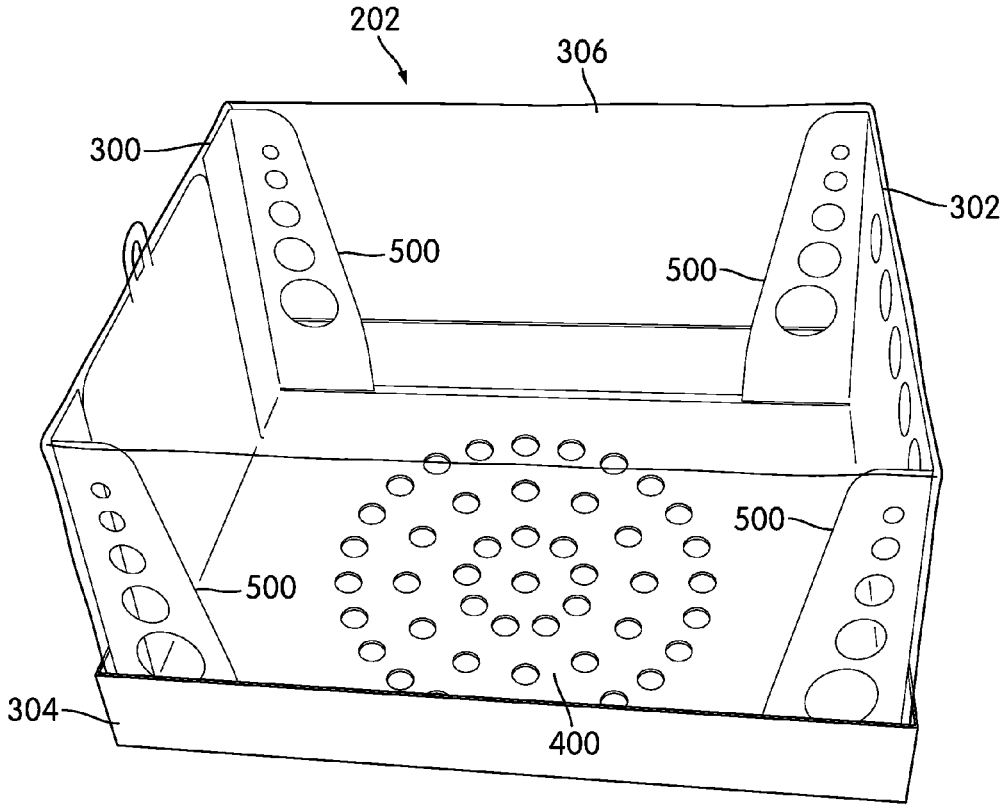
FIG. 5 is an isometric view of an embodiment of a steam tent fully deployed.

FIG. 5 illustrates a fully deployed position of steam tent 202. Right movable support 302 and left movable support 300 are raised from non-use positions to fully deployed positions. In some embodiments, movable supports are fully deployed in an upright position. In some embodiments, movable supports may engage with bottom portion to maintain an upright position. In an exemplary embodiment, right movable support 302 and left movable support 300 may include legs 500 to hold the movable supports upright against bottom portion 304. Cover material 306 can be disposed between fully deployed right movable support 302 and left movable support 300 to form steam tent 202.

Figure 6:
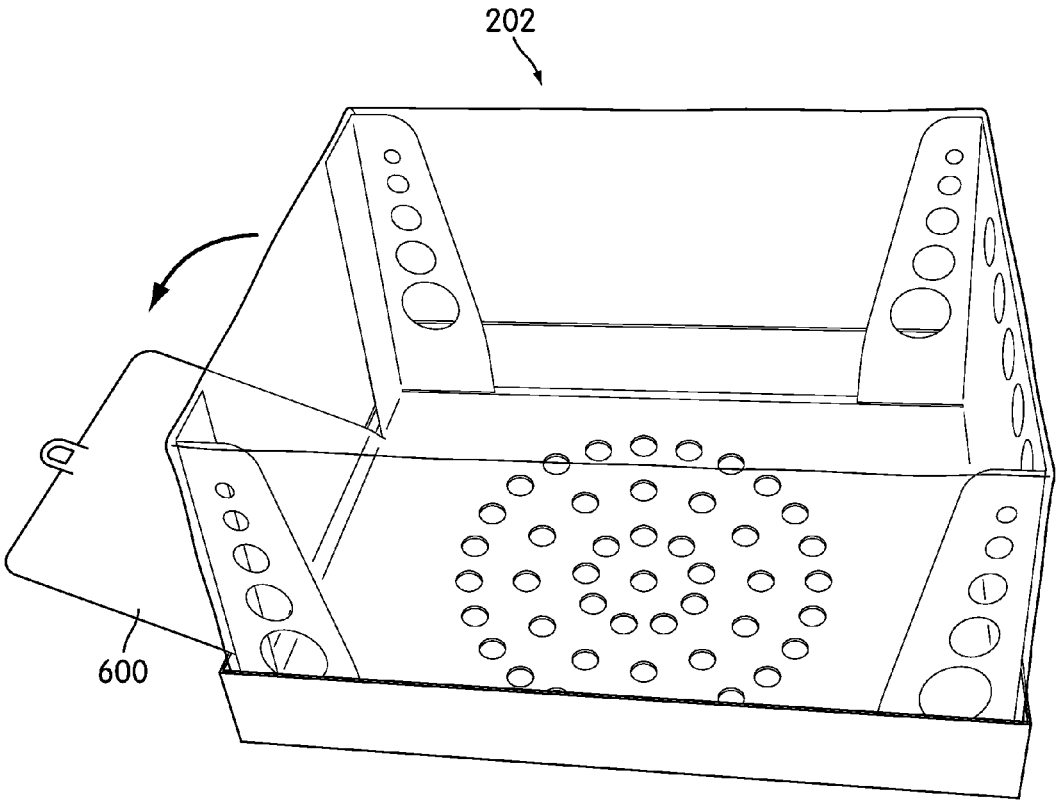
FIG. 6 is an isometric view of an embodiment of a steam tent configured to receive an article of footwear.
Figure 7:
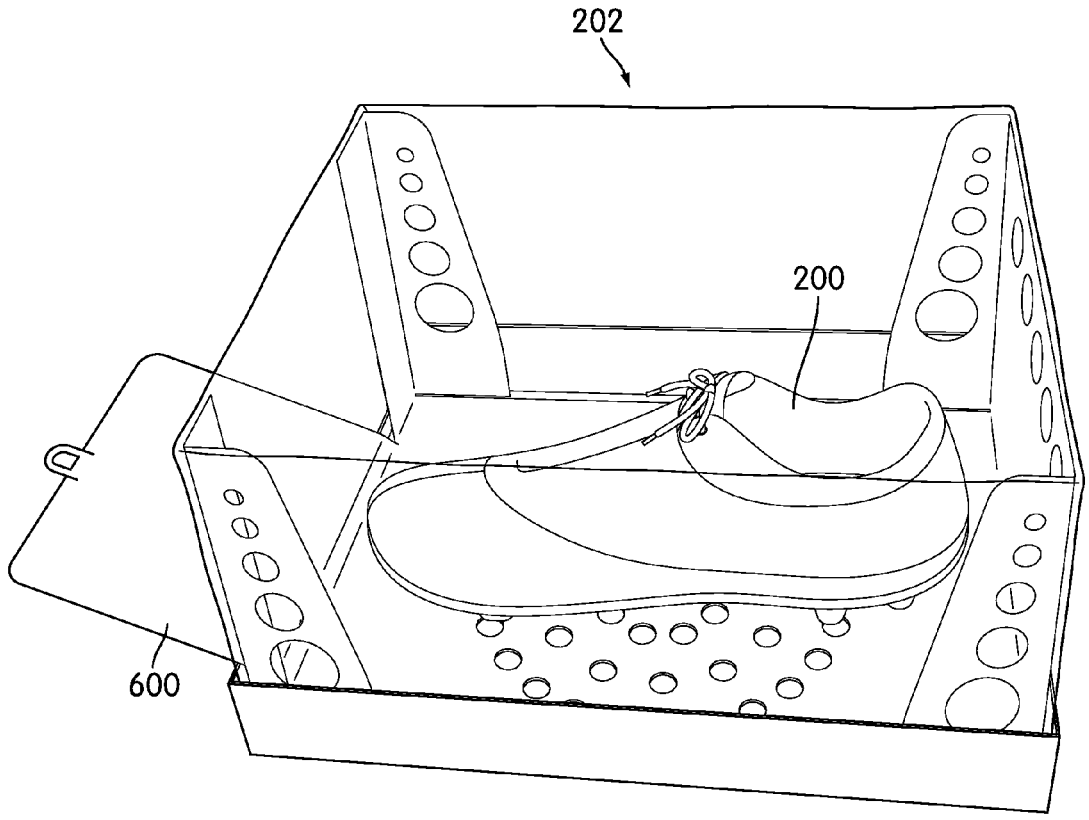
FIG. 7 is an isometric view of an embodiment of a steam tent having an article of footwear disposed within.

Referring to FIGS. 6 and 7, steam tent 202 is illustrated with a door 600. Door 600 allows an article of footwear 200 to be inserted inside steam tent 202. In an exemplary embodiment, door 600 may be provided along one side of steam tent 202. In other embodiments, any entry point may be provided that allows an article of footwear to be placed in the interior of steam tent. FIG. 7 illustrates an exemplary embodiment of steam tent 202 containing an article of footwear 200. Article of footwear can be placed inside steam tent in any position. As illustrated in FIG. 7, after article of footwear 200 is placed inside steam tent 202, door 600 can be closed or sealed.

Figure 8:
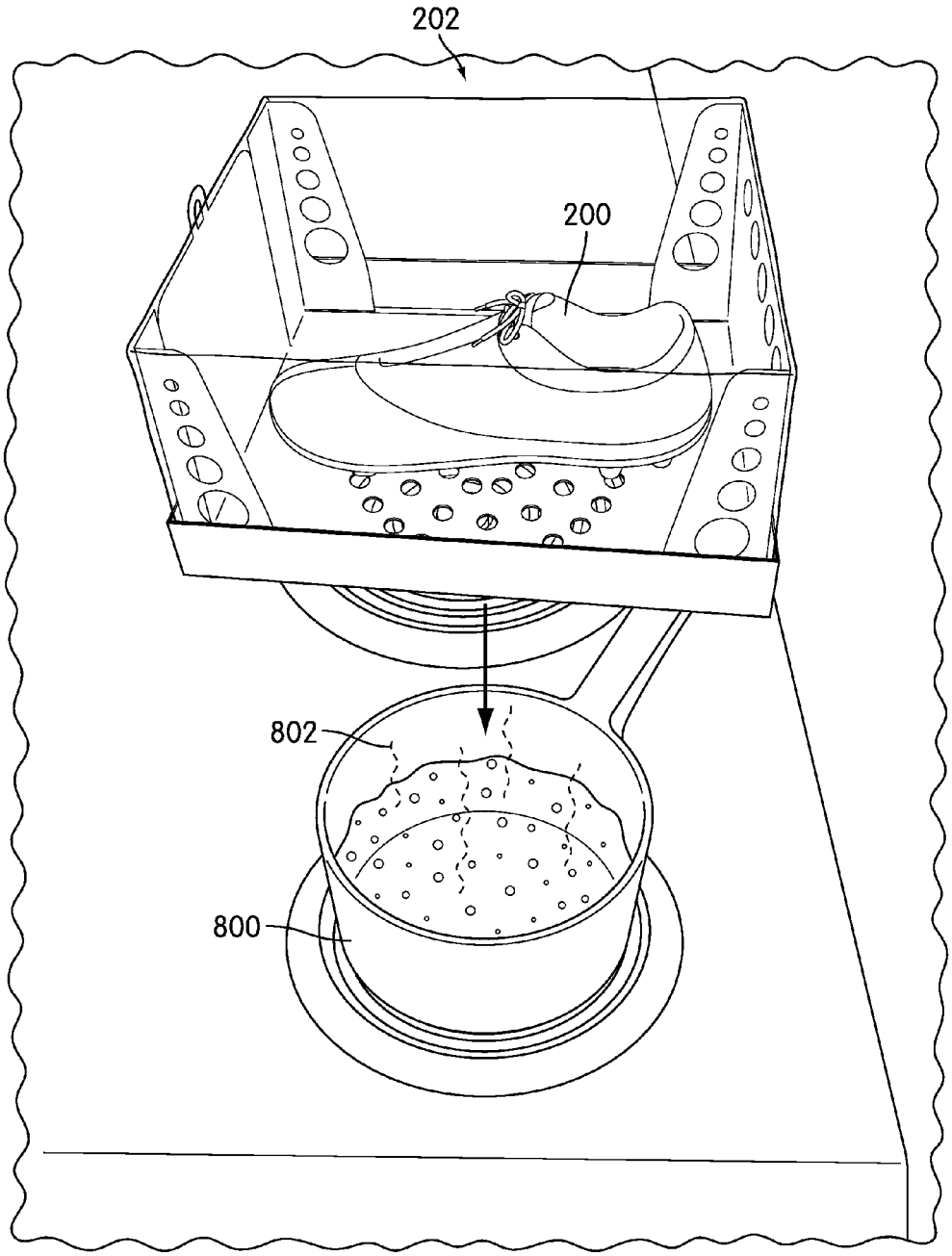
FIG. 8 is an isometric view of an embodiment of a steam tent containing an article of footwear disposed in proximity to a steam source.

FIG. 8 illustrates an exemplary embodiment of a source of steam 802. In this embodiment, a source of steam 802 is a pot 800 containing boiling water. In other cases, a source of steam may be provided by introducing water to a heat source, including, but not limited to: a microwave, an oven, a stovetop, a heating coil, as well other sources of steam.

Figure 9:
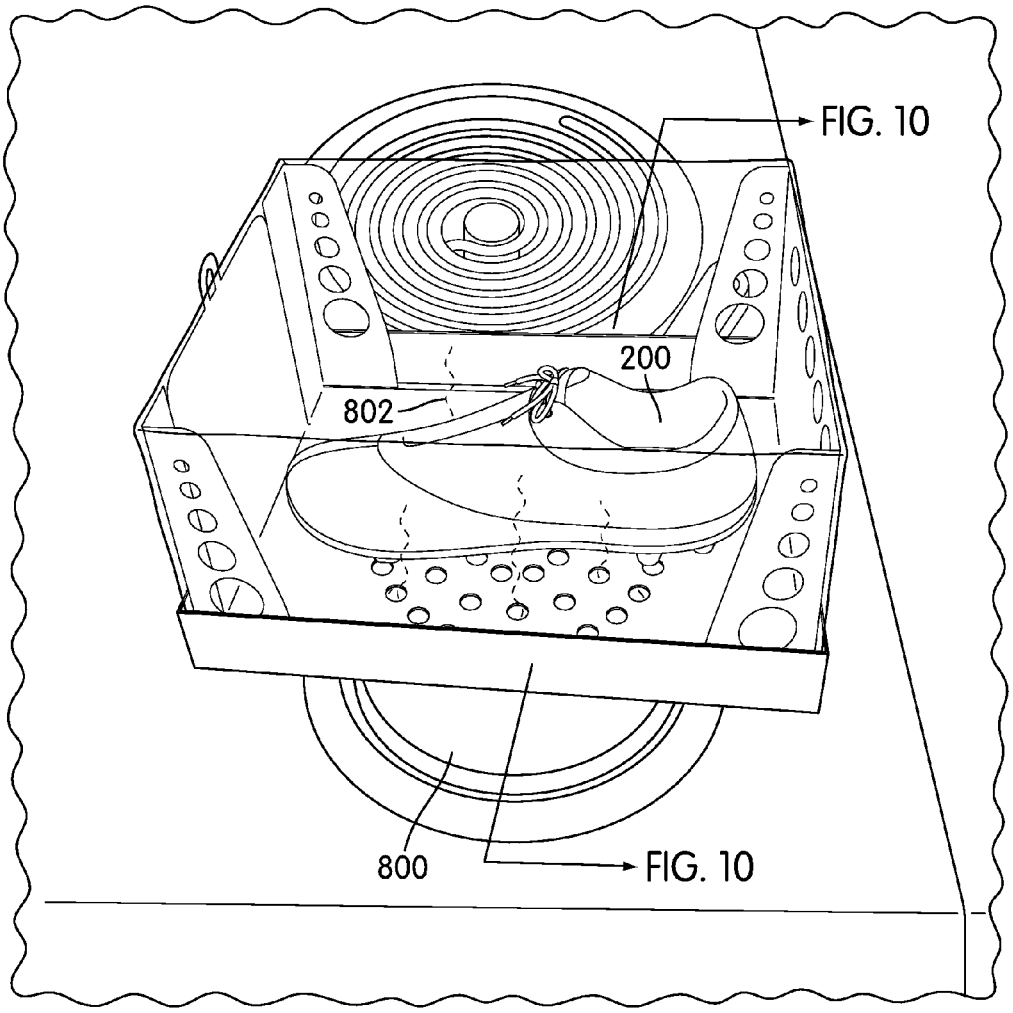
FIG. 9 is an isometric view of an embodiment of a steam tent containing an article of footwear being subjected to steam.
Figure 10:
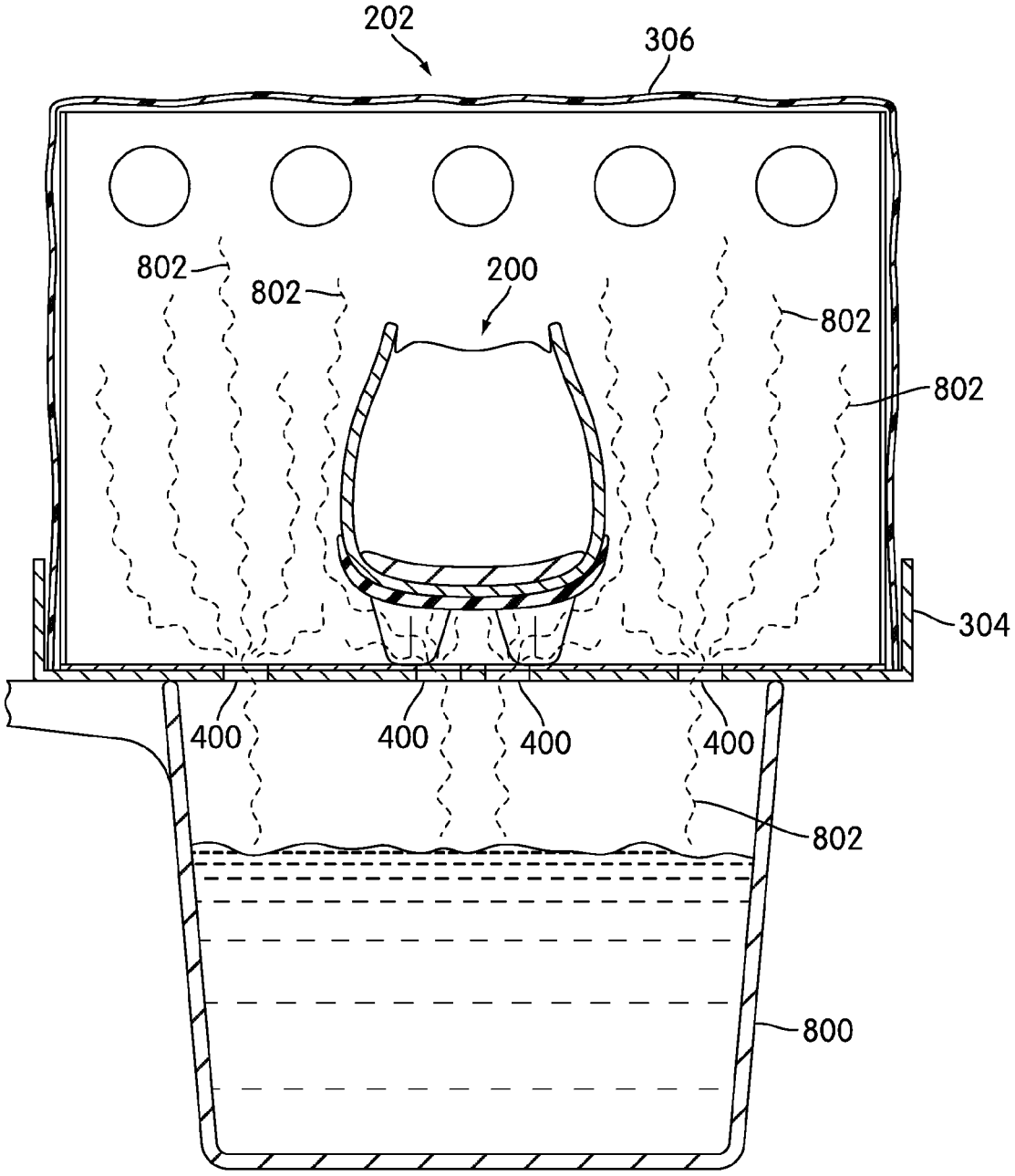
FIG. 10 is a cross sectional view of an embodiment of a steam tent containing an article of footwear being subjected to steam.

Referring to FIGS. 9 and 10, steam tent 202 can be placed in proximity to a source of steam 802. In this embodiment, steam tent 202 is placed over pot 800 containing boiling water. As illustrated in FIG. 10, steam 802 enters from pot 800 into the interior of steam tent 202 through holes 400 in the bottom portion 304 of steam tent 202. Steam 802 moves around article of footwear 200. Steam 802 is trapped inside steam tent 202 by cover material 306. Article of footwear 200 can be subjected to steam environment inside steam tent 202.

Figure 11:
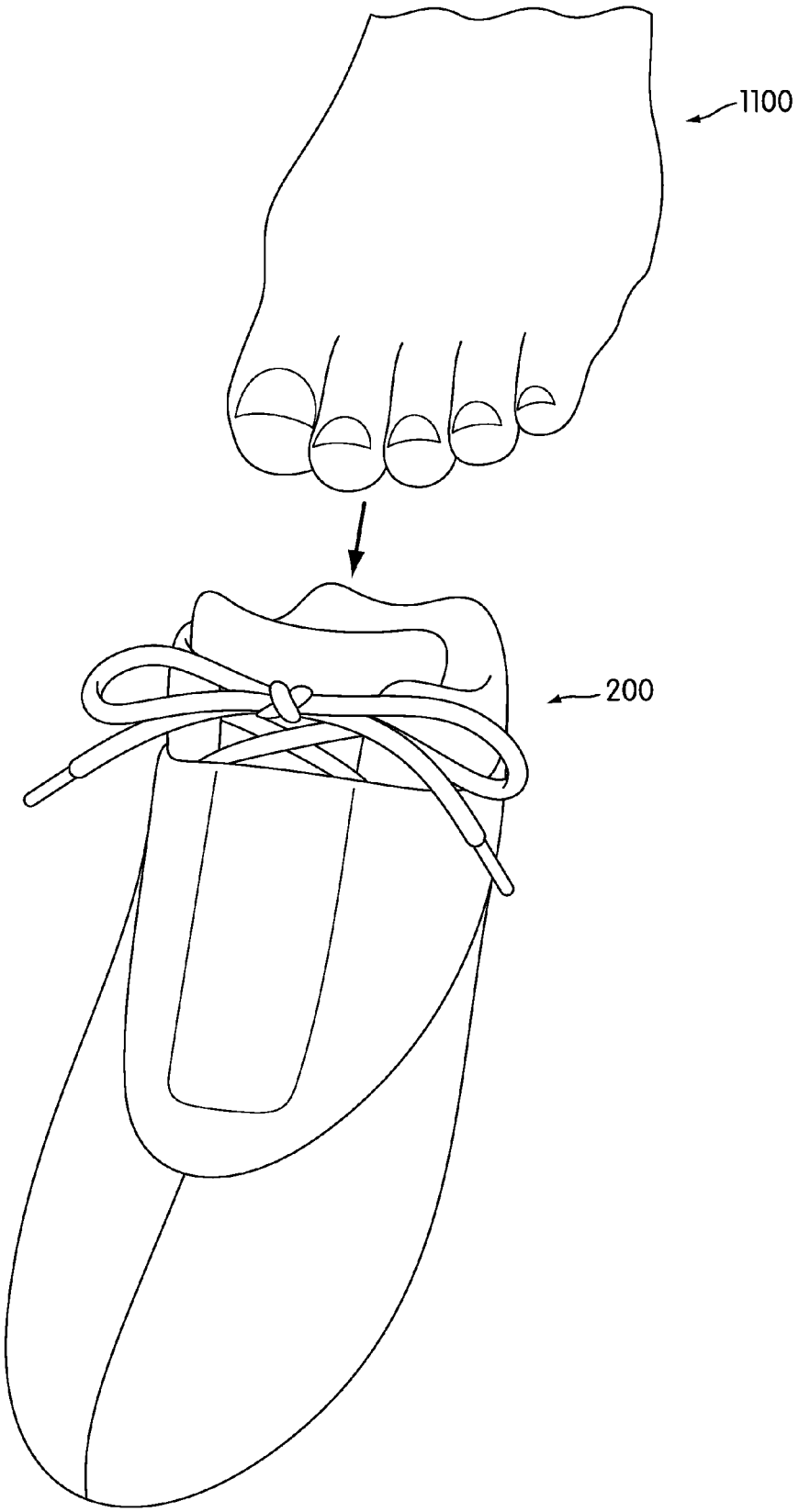
FIG. 11 is an isometric view of an embodiment of an article of footwear after being subjected to steam.
Figure 12:
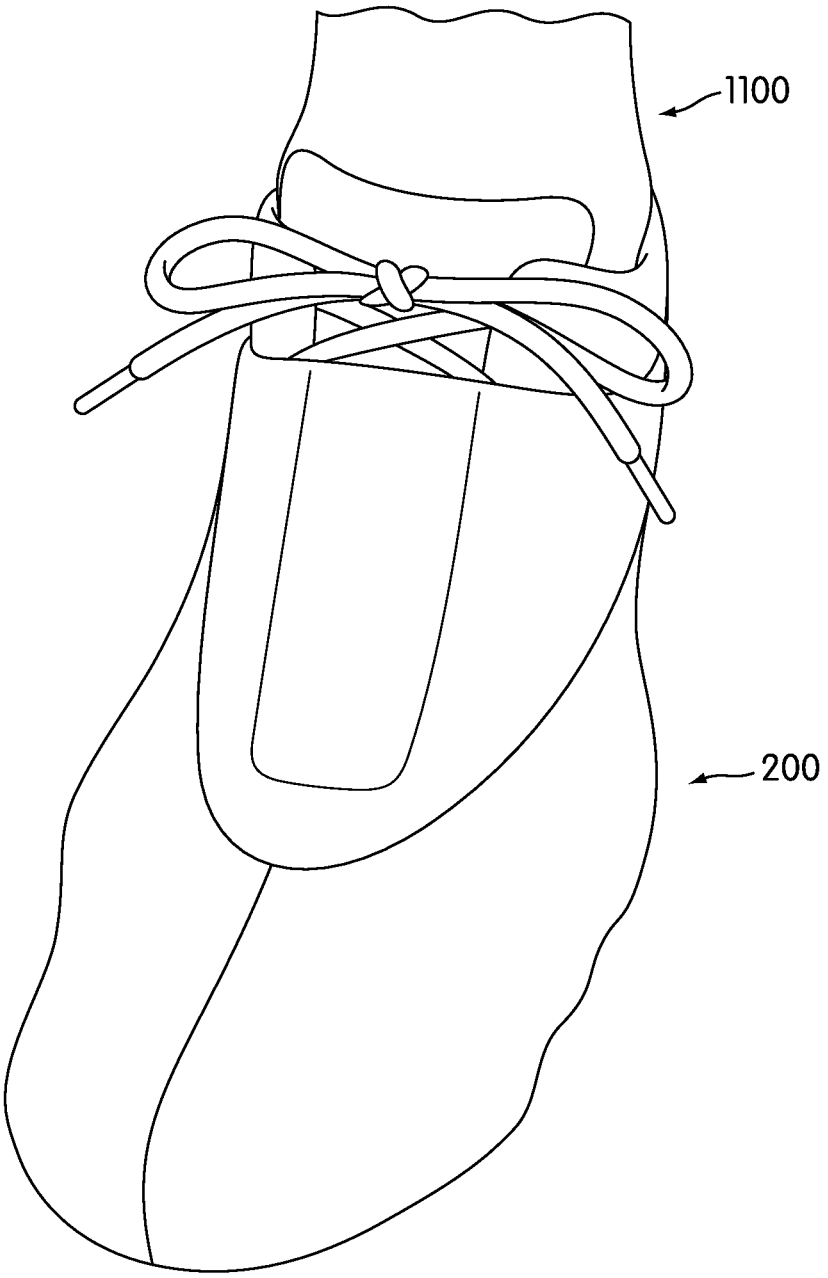
FIG. 12 is an isometric view of an embodiment of an article of footwear receiving a foot after being subjected to steam.
Figure 13:
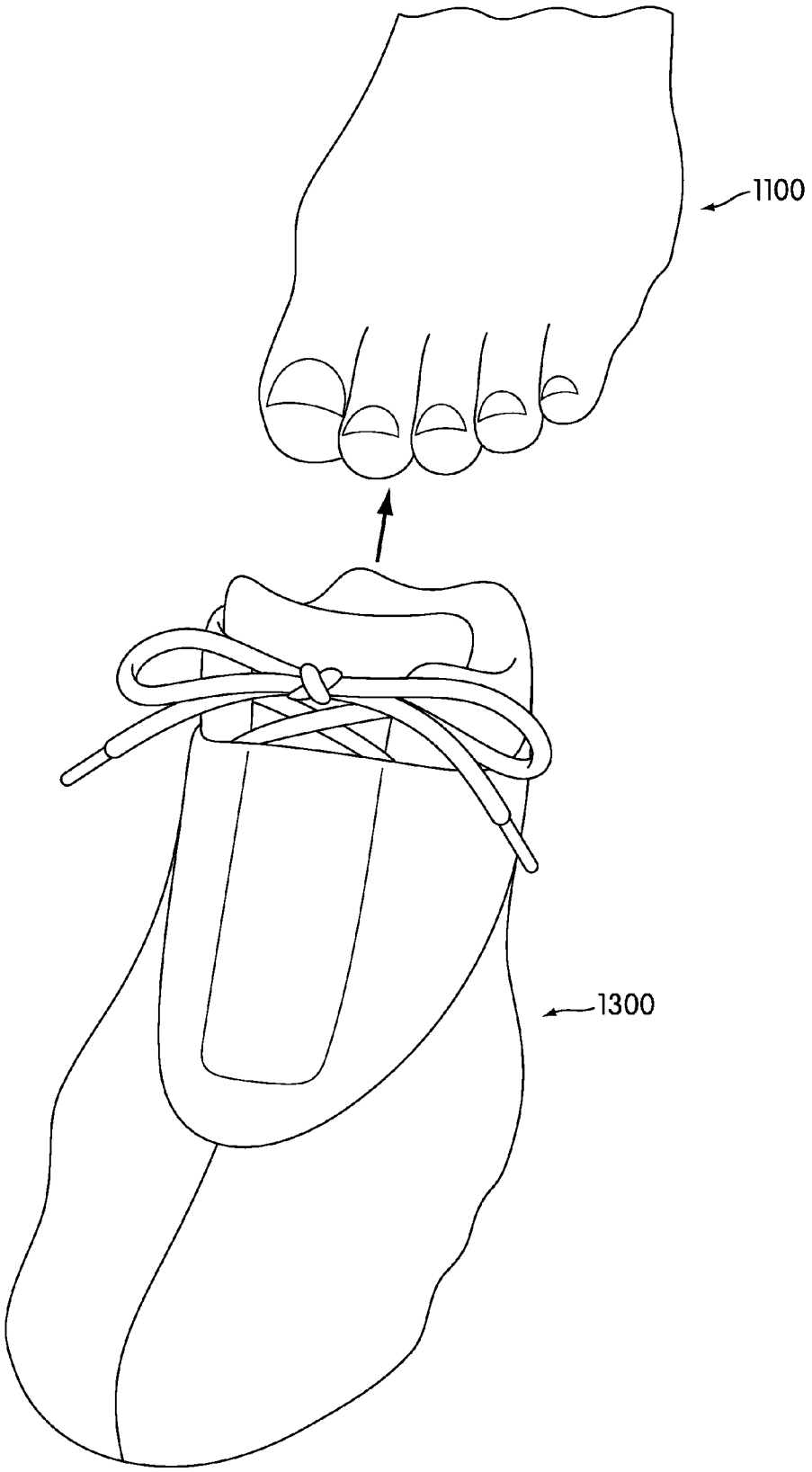
FIG. 13 is an isometric view of an embodiment of an article of footwear after being molded.

FIGS. 11-13 illustrate an embodiment of a method of custom fitting an article of footwear. For purposes of illustration, FIGS. 11-13 illustrate an embodiment of a method of custom fitting an article of footwear using a post-manufacturing customization system. However, the method of custom fitting an article of footwear described herein may be performed on an article of footwear subjected to a steam environment by any method.

Some embodiments may include provisions for instructing a user about how to customize an article of footwear. Generally, a set of instructions may be supplied in any format. In some cases, the set of instructions may be a printed copy of instructions. In one exemplary embodiment, instructions for custom fitting an article of footwear can be provided as a booklet within the container. In different embodiments, instructions for custom fitting an article of footwear may be provided in the container in various ways, including, but not limited to: as an instruction sheet, booklet, diagram or other printed material. In other embodiments, instructions for custom fitting an article of footwear may be printed on a container lid. In some cases, instructions for custom fitting an article of footwear may be printed on a steaming apparatus. In an exemplary embodiment instructions may be printed on a bottom portion, a top portion or both of a steam tray. In another exemplary embodiment, instructions may be printed on a cover material of a steam tent. In different embodiments, instructions may be provided both in the container and on a steaming apparatus.

Referring to FIG. 11, an article of footwear 200 is shown that has been subjected to a steam environment according to an exemplary embodiment. Article of footwear may be subjected to steam environment for a specified duration of time. The duration of time may vary and allows article of footwear to be exposed to steam environment for a sufficient amount of time to become moldable. In some cases, the duration of time may vary depending on the type of article of footwear. In other cases, the duration of time may vary depending on the size of article of footwear or may be the same for all types of article of footwear. As illustrated in FIG. 11, article of footwear 200 is removed from the steam environment and readied for a foot 1100 to be inserted.

Referring to FIG. 12, an embodiment of custom fitting an article of footwear to a foot is shown. As illustrated in FIG. 12, after article of footwear 200 is removed from the steam environment, foot 1100 is inserted into article of footwear 200. In some cases, a foot may be kept inside article of footwear for a predetermined amount of time sufficient to allow article of footwear to conform to the shape and contours of the foot. Article of footwear can be composed of a moldable material that can stretch or shrink to assume a customized shape. Moldable material allows article of footwear to be custom fitted to a foot as the article of footwear cools. Moldable material may be any material that becomes pliable at an elevated temperature and is capable of retaining a shape as it cools. In some embodiments, the moldable material may be synthetic leather. In some cases, article of footwear may contain multiple moldable materials with different properties, including, but not limited to: pliability, temperature at which it becomes moldable, hardness, as well as other characteristics.

FIG. 13 illustrates an article of footwear that has been custom fitted to a foot. As illustrated in FIG. 13, custom-fitted article of footwear 1300 retains its shape and contours molded from contact with the foot after the foot is removed from article of footwear 1300. The method of custom fitting an article of footwear results in an article of footwear 1300 that closely fits the shape and contour of the foot that was inserted in article of footwear 1300 while it cooled.

Figure 14:
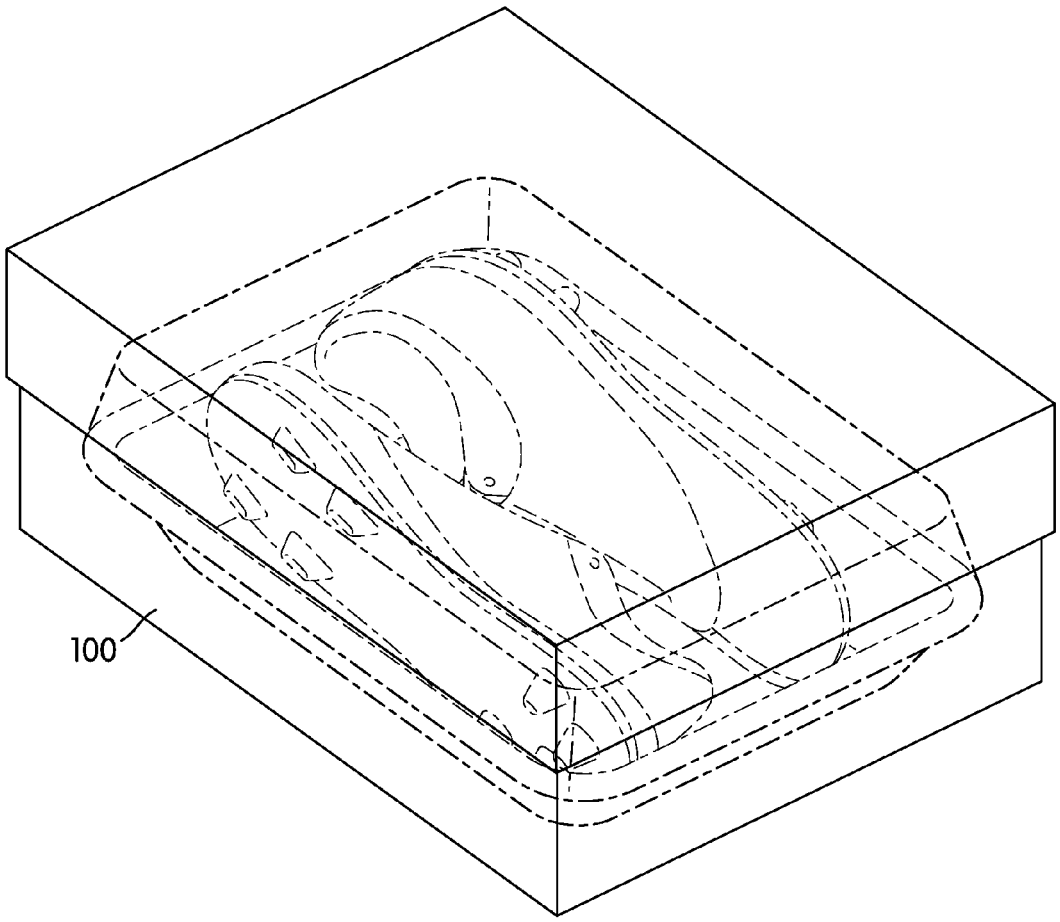
FIG. 14 is an isometric view of an exemplary embodiment of a container including a steam tray.
Figure 15:
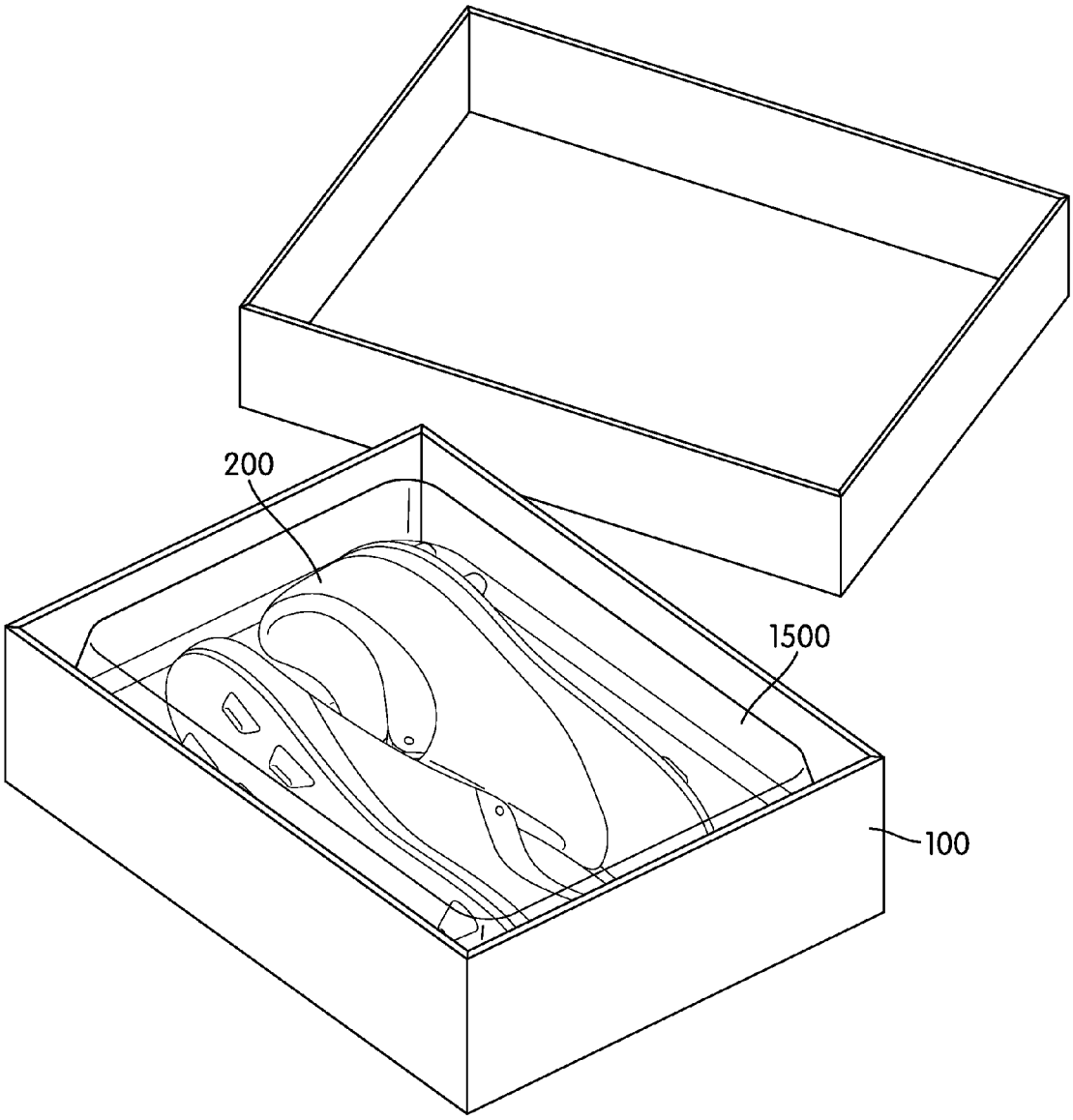
FIG. 15 is an isometric view of an embodiment of an opened container including a steam tray.

FIGS. 14-22 illustrate another embodiment of an apparatus for steaming an article of footwear. Referring to FIG. 14, an apparatus for steaming an article of footwear may be included in a container 100 for holding an article of footwear. The container 100 holds an article of footwear and steaming apparatus. As illustrated in FIG. 15, in this embodiment, steaming apparatus is a steam tray 1500 that is provided in the container 100 for holding an article of footwear 200. In this embodiment, article of footwear 200 can be packaged inside steam tray 1500 in container 100. In other embodiments, article of footwear and steam tray may be packaged separately in the container.

Figure 16:
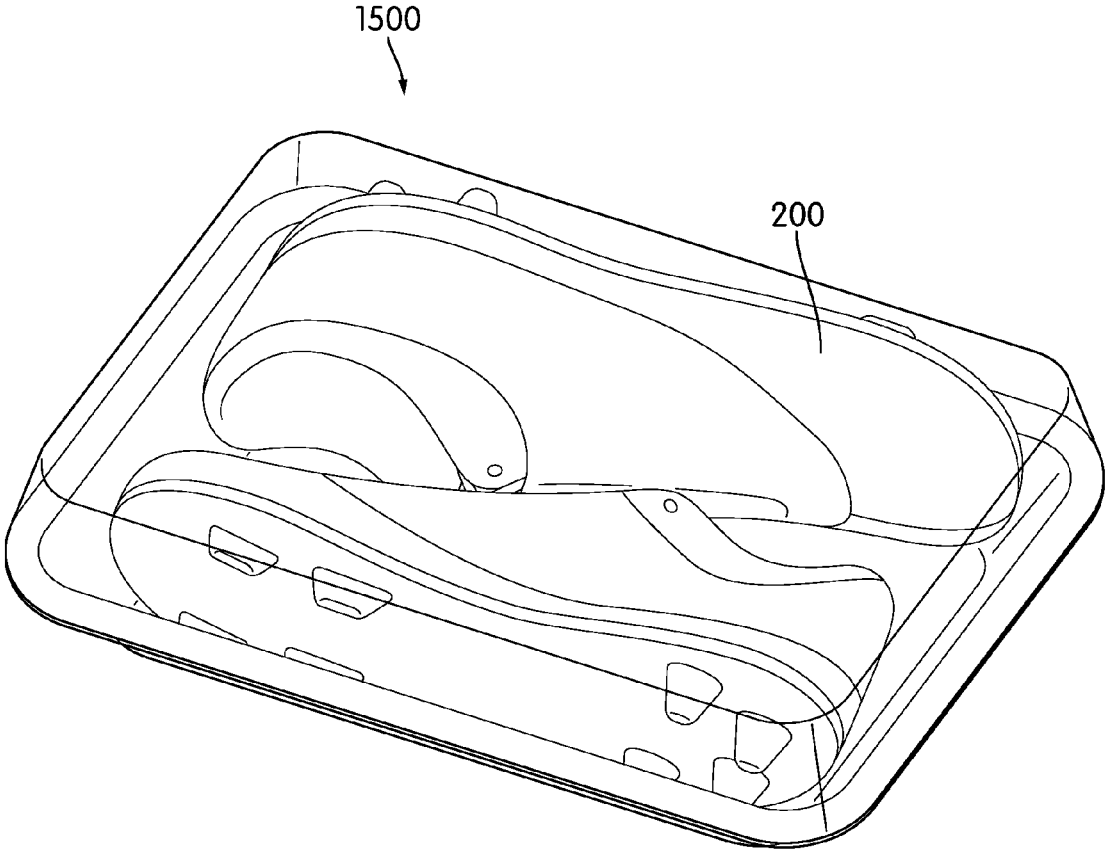
FIG. 16 is an isometric view of an embodiment of a steam tray.

FIG. 16 illustrates an exemplary embodiment of a steaming apparatus where steaming apparatus is a steam tray. Referring to FIG. 16, steam tray 1500 sized and dimensioned to receive an article of footwear 200 can be included inside a container. In some embodiments, the steam tray may be held by a sleeve while in the container. In other embodiments, a sleeve may not be included to hold the steam tray.

Figure 17:
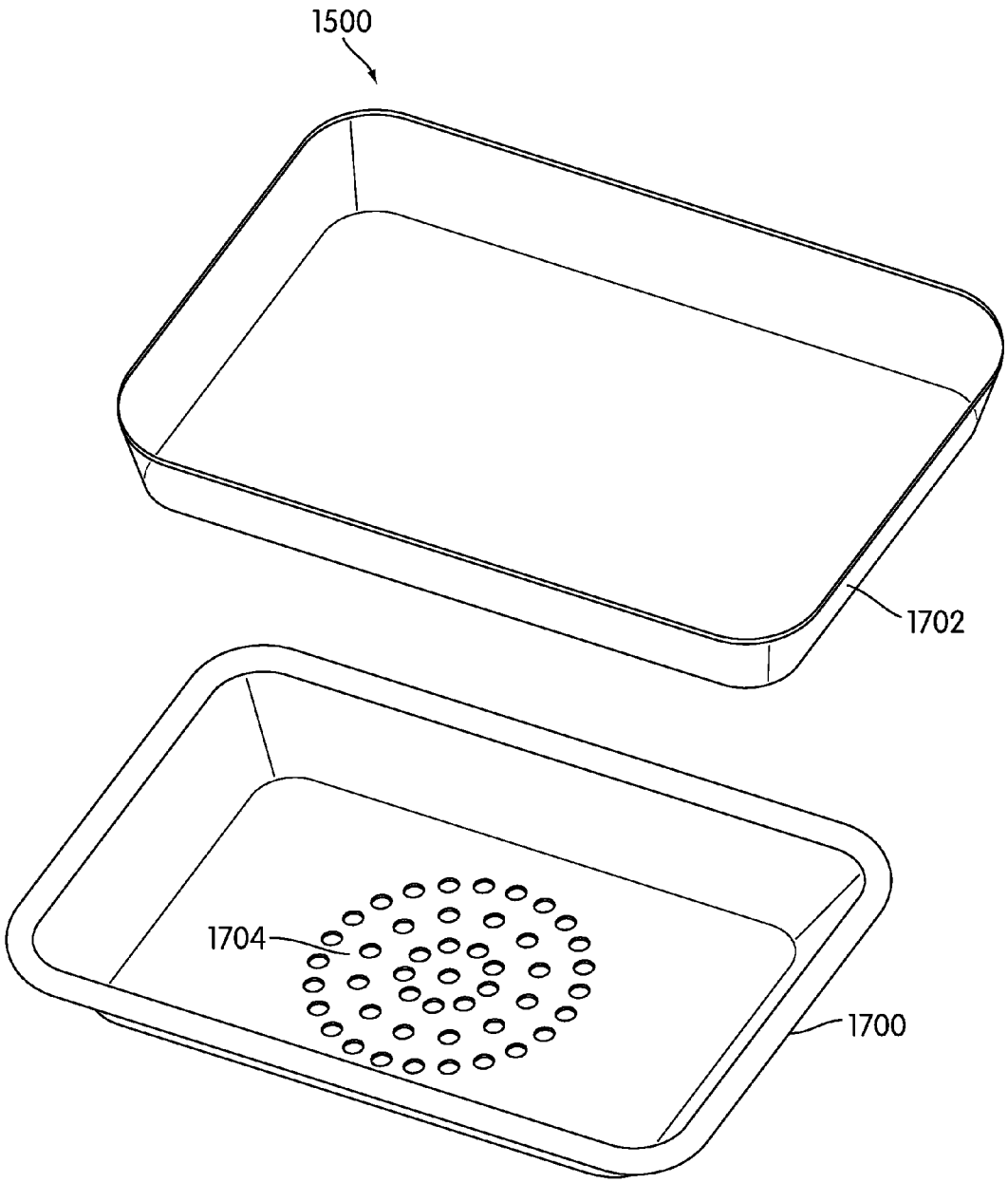
FIG. 17 is an isometric view of an exemplary embodiment of a steam tray.

FIG. 17 illustrates an embodiment of steam tray 1500. In this embodiment steam tray 1500 can include a bottom portion 1700 and a top portion 1702. Bottom portion 1700 is provided with holes 1704 for allowing steam to enter into steam tray 1500 and subject an article of footwear to a steam environment. In some cases, bottom portion may be metal. In other cases, bottom portion may be plastic. In one embodiment, top portion 1702 is releasably engaged to bottom portion 1700. In some embodiments, top portion may be detachable from bottom portion. In other embodiments, top portion may be attached to bottom portion. In some cases, top portion may be rigid. In other cases, top portion may be a sheet or film. In addition, in some cases, top portion may be transparent or semi-transparent. In other cases, top portion may be opaque or nontransparent.

Figure 18:
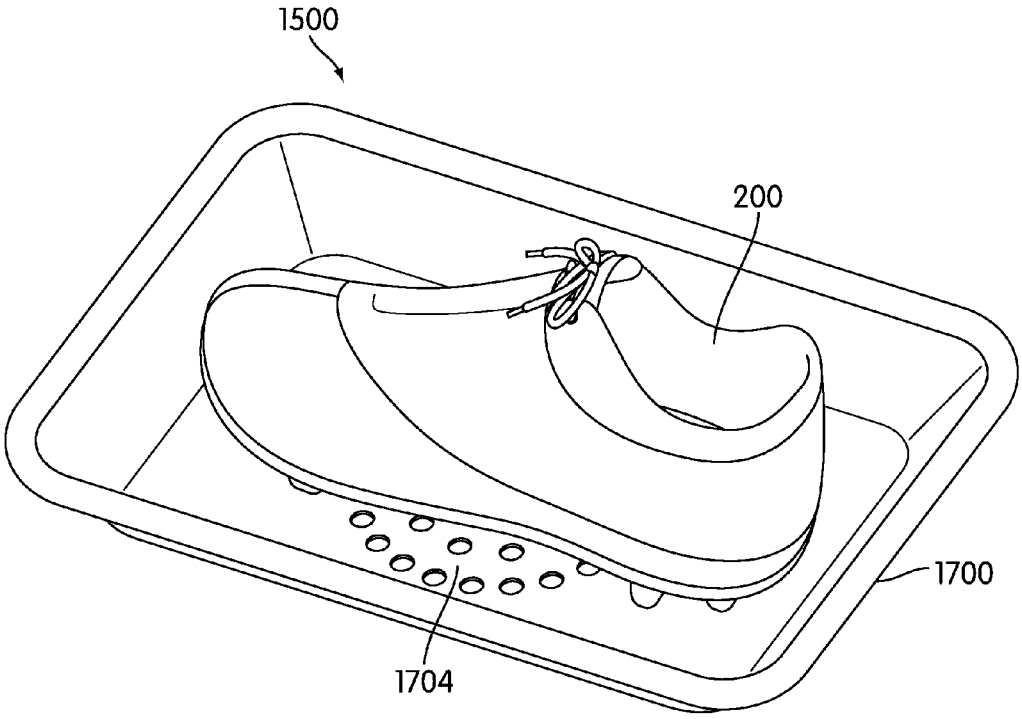
FIG. 18 is an isometric view of an embodiment of a steam tray positioned to receive an article of footwear within.
Figure 19:
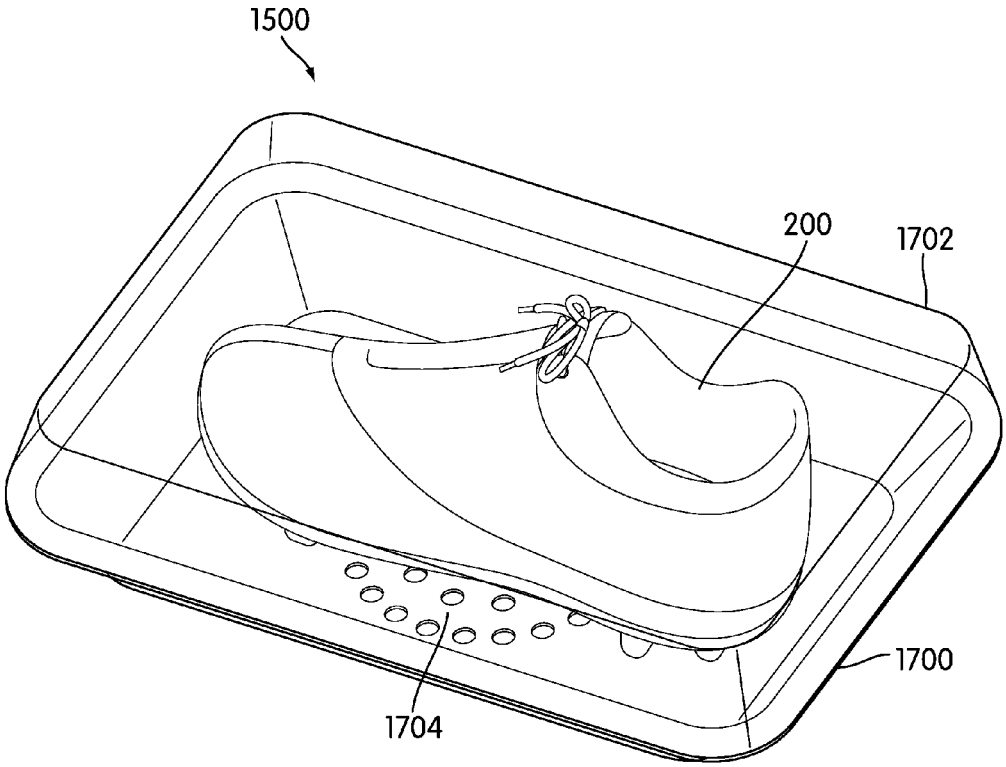
FIG. 19 is an isometric view of an embodiment of a steam tray containing an article of footwear.

Referring to FIGS. 18 and 19, steam tray 1500 can be sized and dimensioned to receive an article of footwear 200. In some cases, a steam tray may be provided of a size and dimension to receive a specific type of article of footwear. In other cases, a steam tray is sized and dimensioned to receive multiple types of article of footwear. As illustrated in FIG. 18, bottom portion 1700 of steam tray 1500 receives article of footwear 200. Referring to FIG. 19, top portion 1702 is placed over bottom portion 1700 to enclose article of footwear 200 within steam tray 1500. Article of footwear may be placed into the bottom portion of steam tray in any position.

Figure 20:
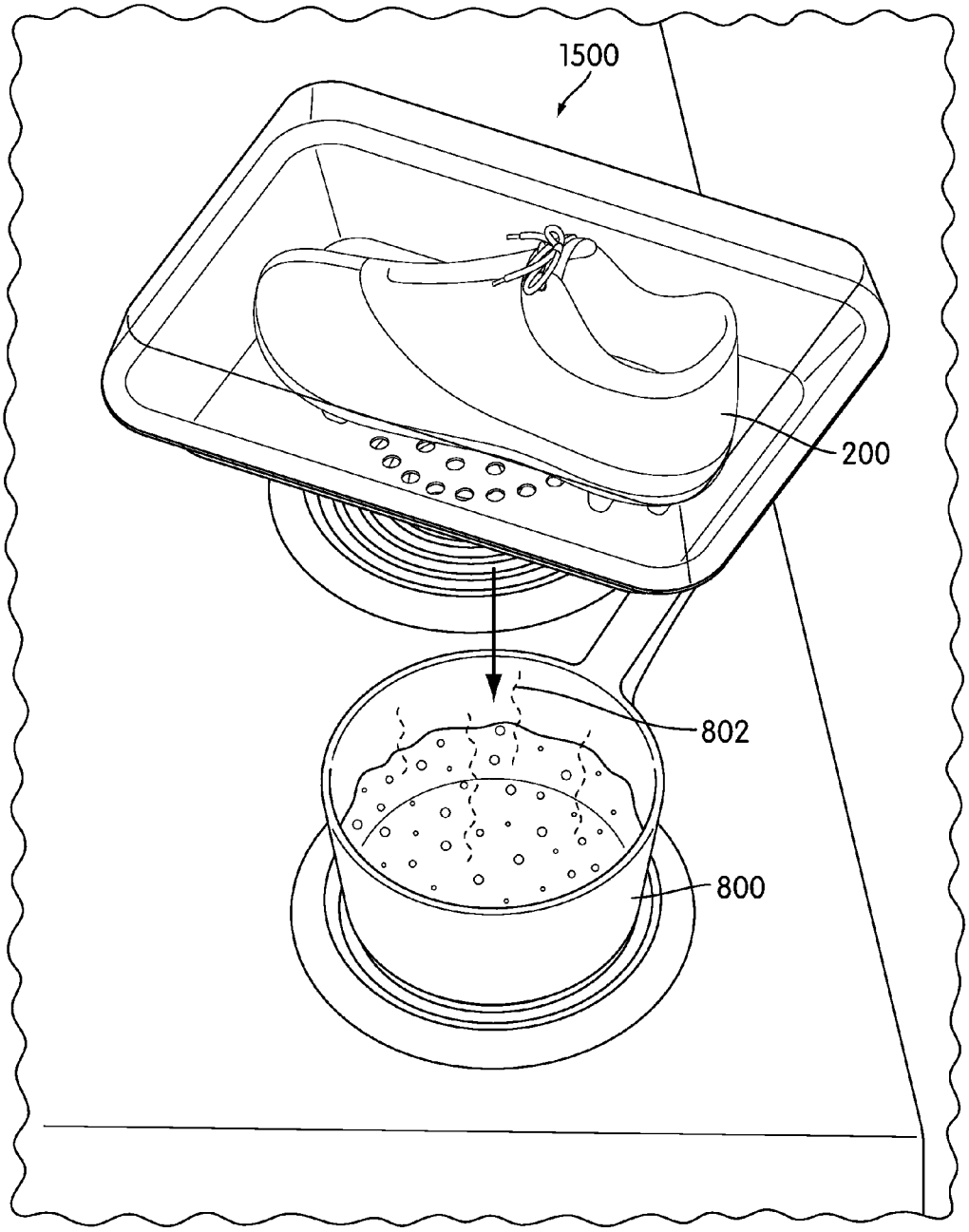
FIG. 20 is an isometric view of an embodiment of a steam tray containing an article of footwear disposed in proximity to a steam source.
Figure 21:
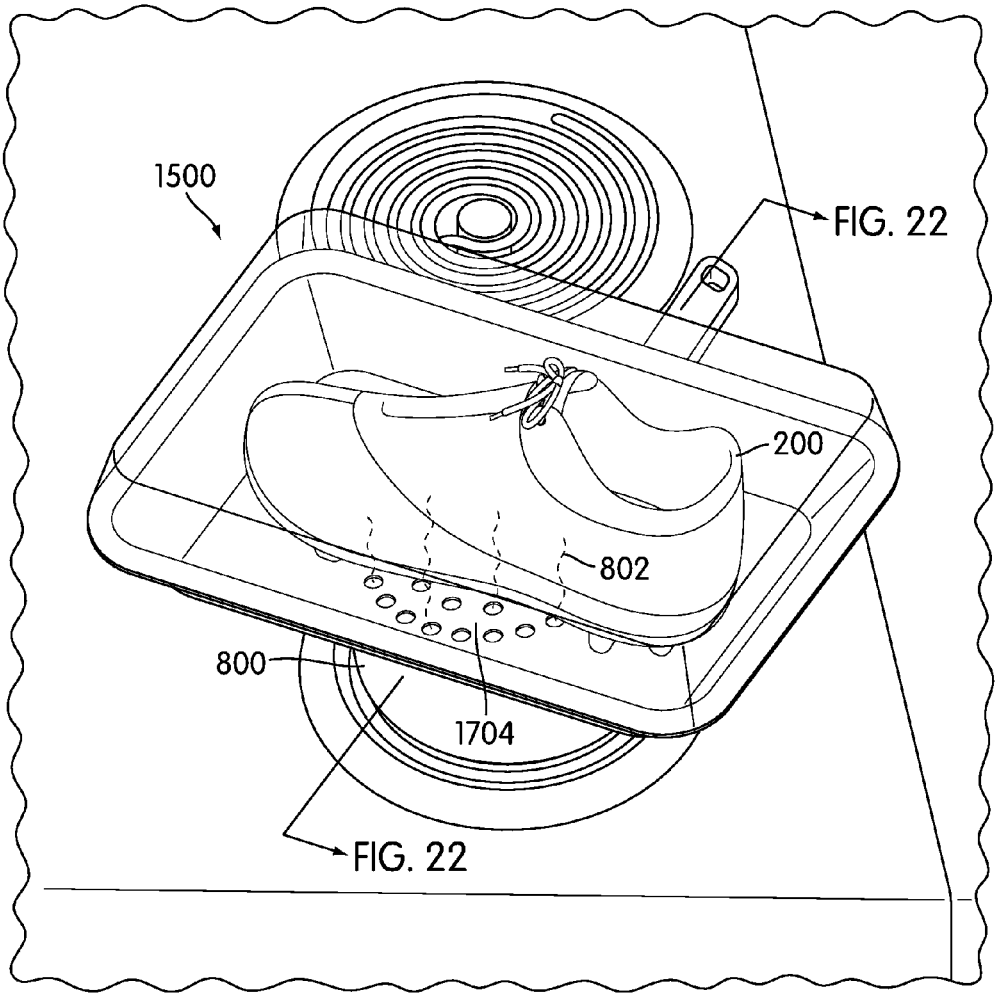
FIG. 21 is an isometric view of an embodiment of a steam tray containing an article of footwear being subjected to steam.
Figure 22:
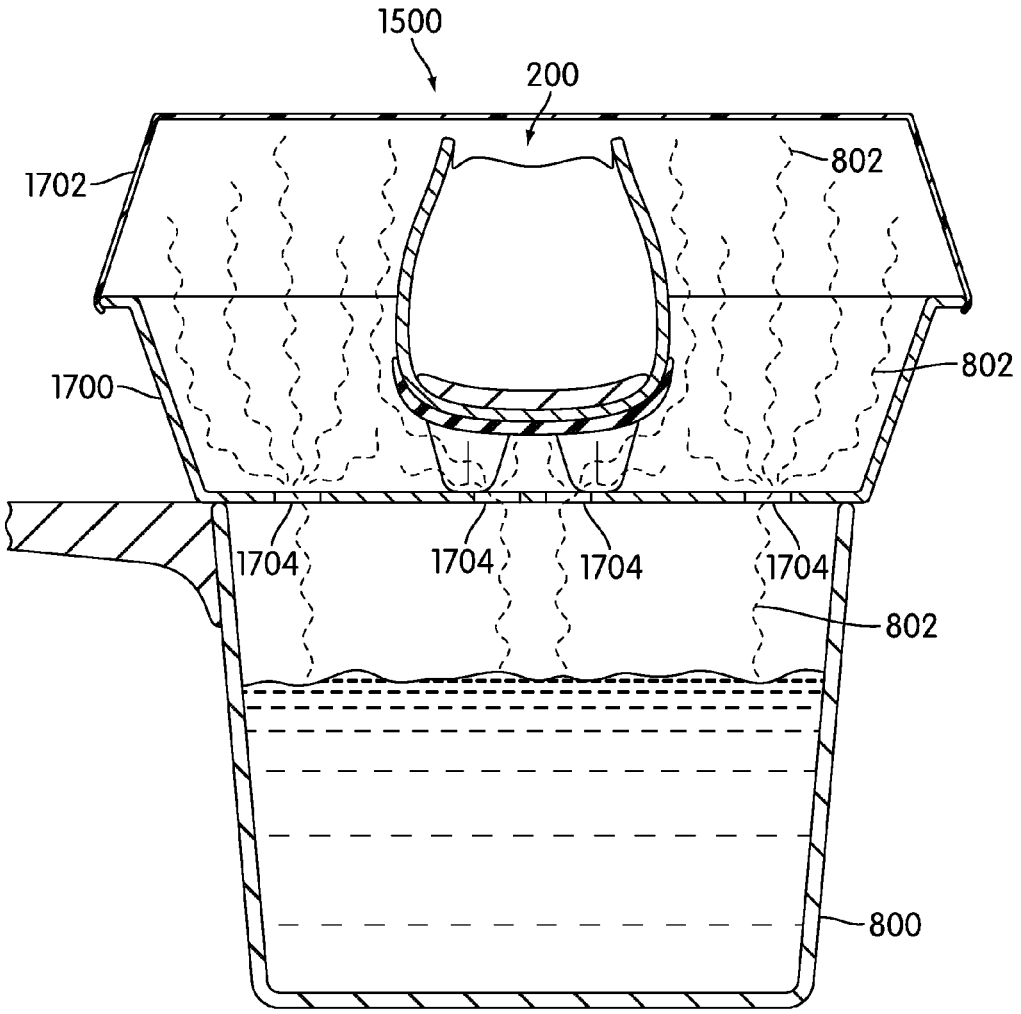
FIG. 22 is a cross sectional view of an embodiment of a steam tray containing an article of footwear being subjected to steam.

FIGS. 20-22 illustrate an exemplary embodiment of a steam tray containing an article of footwear subjected to a steam environment. Referring to FIG. 20, steam tray 1500 can be placed in proximity to a source of steam 802. As illustrated in FIG. 21, in this embodiment, steam tray 1500 is placed over a pot 800 containing boiling water. As illustrated in FIG. 22, steam 802 enters from pot 800 into the interior of steam tray 1500 through holes 1704 in the bottom portion 1700 of steam tray 1500. Steam 802 moves around article of footwear 202. Steam 802 is trapped inside steam tray 1500 by top portion 1702. Article of footwear can be subjected to steam environment inside steam tray. Article of footwear is then custom fitted as illustrated in FIGS. 11-13 and as discussed above.

Figure 23:
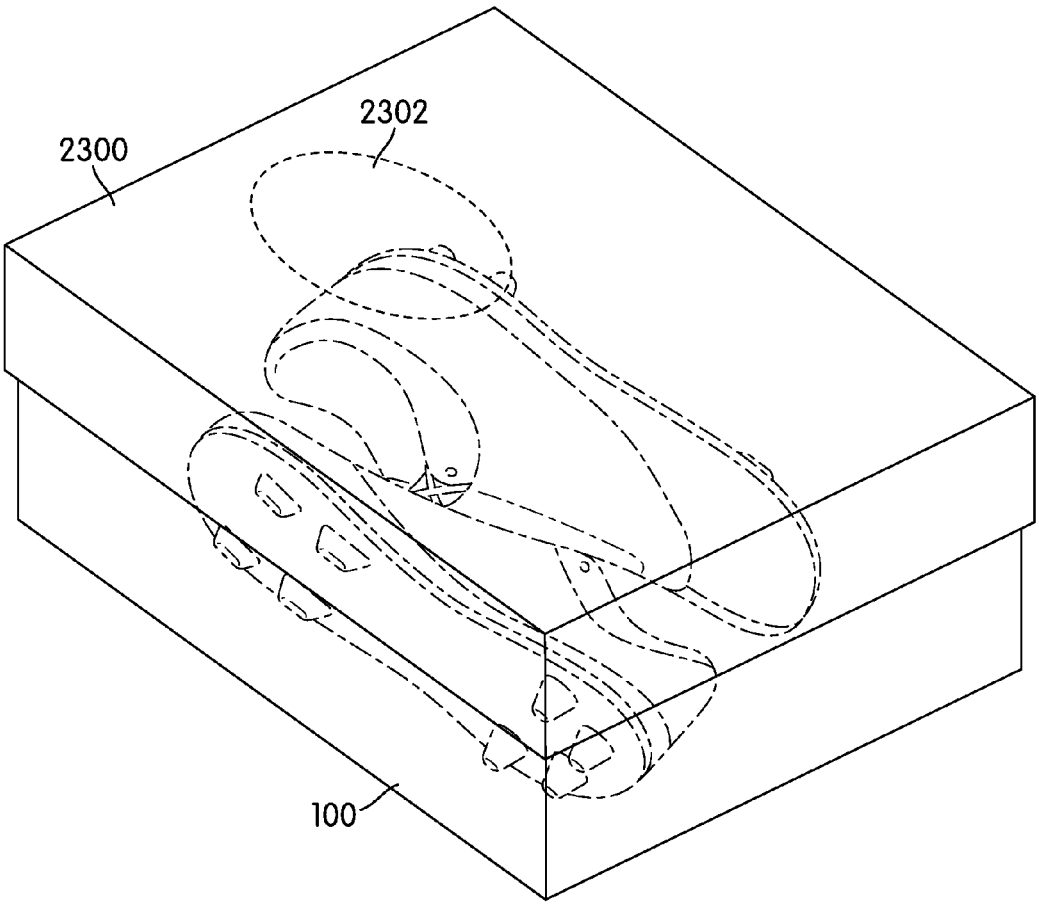
FIG. 23 is an isometric view of an exemplary embodiment of a container with a lid having a predetermined removable area.

FIGS. 23-32 illustrate another embodiment of an apparatus for steaming an article of footwear. Referring to FIG. 23, an apparatus for steaming an article of footwear may be provided as the lid 2300 of container 100.

FIG. 23 illustrates an exemplary embodiment of a steaming apparatus where steaming apparatus is the container lid. Referring to FIG. 23, container lid 2300 is provided with a predetermined removable area 2302 sized and dimensioned to fit a portion of an article of footwear. The predetermined removable area may be provided on container lid in any location.

Figure 24:
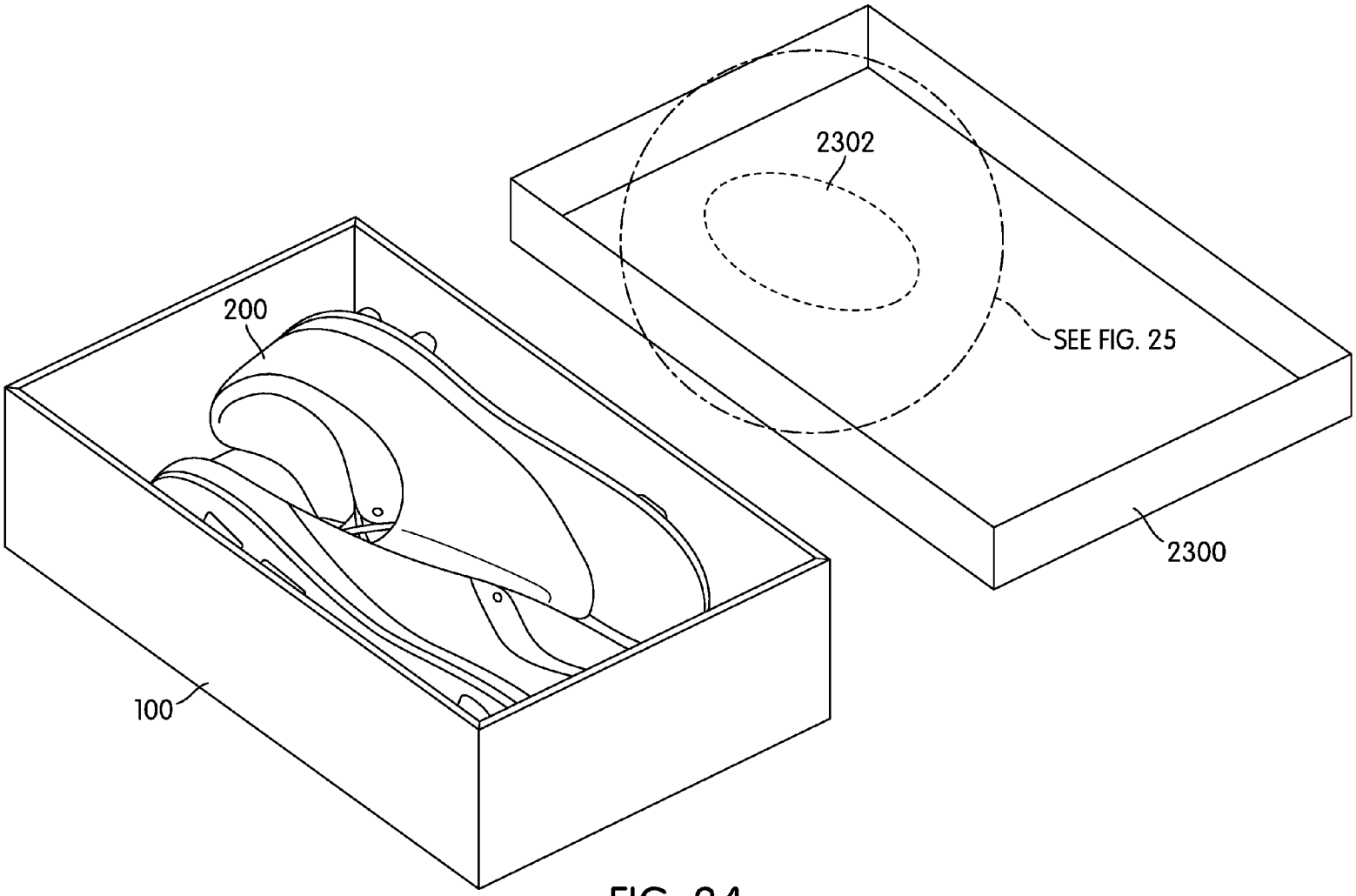
FIG. 24 is an isometric view of an embodiment of an opened container with a lid having a predetermined removable area.

FIG. 24 illustrates an embodiment of a steaming apparatus provided as a container lid. In an exemplary embodiment, container lid 2300 is configured as a steaming apparatus by forming a hole in lid 2300 of container 100 sized and dimensioned to hold a portion of an article of footwear 200. A predetermined removable area 2302 is provided on container lid 2300 of a size and dimension of the hole to be formed in container lid 2300.

Figure 25:
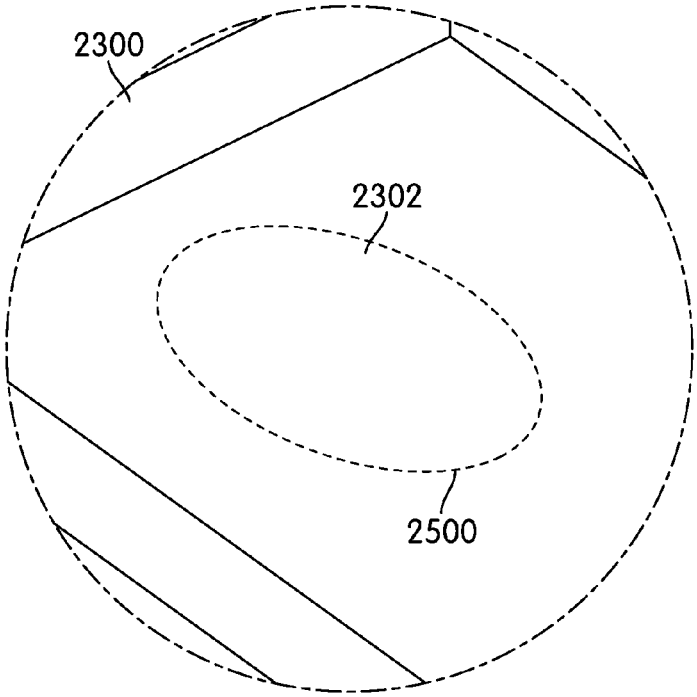
FIG. 25 is an isometric view of an embodiment of a lid having a predetermined removable area.

Referring to FIG. 25, predetermined removable area 2302 is sized and dimensioned to receive a portion of an article of footwear 200. In this embodiment, predetermined removable area 2302 is indicated by a delineated outline 2500 on container lid 2300. In some cases, predetermined removable area may be of a size and dimension to receive a portion of a specific type of article of footwear. In other cases, predetermined removable area is sized and dimensioned to receive a portion of multiple types of article of footwear. In other cases, predetermined removable area may consist of multiple predetermined removable areas.

Figure 26:
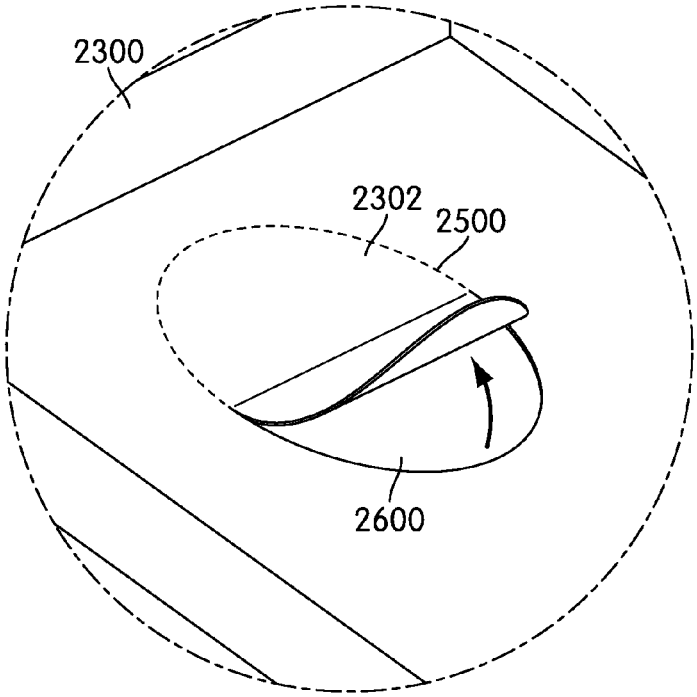
FIG. 26 is an isometric view of an embodiment of a lid having a predetermined removable area with the removable area partially removed.
Figure 27:
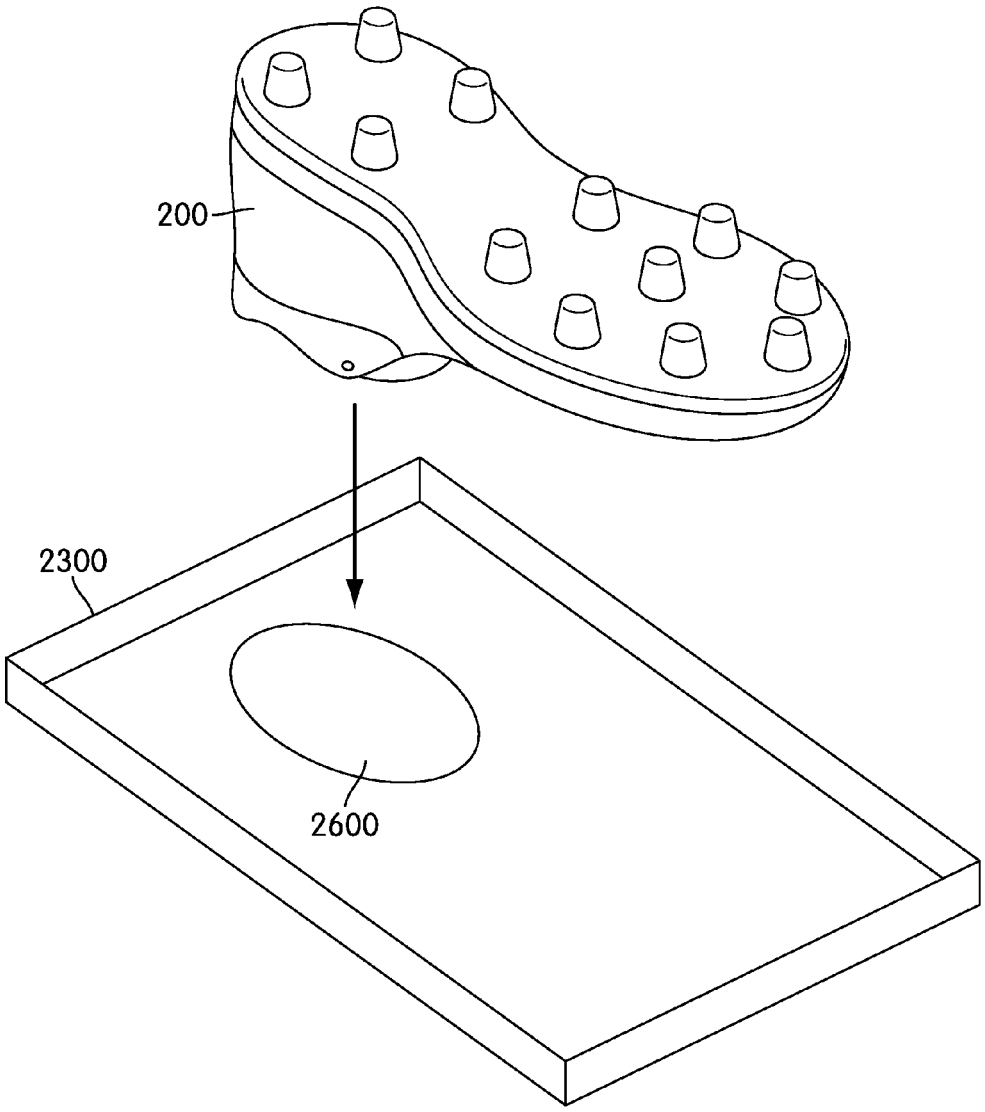
FIG. 27 is an isometric view of an exemplary embodiment of a lid having a hole with an article of footwear positioned to be inserted into the hole.
Figure 28:
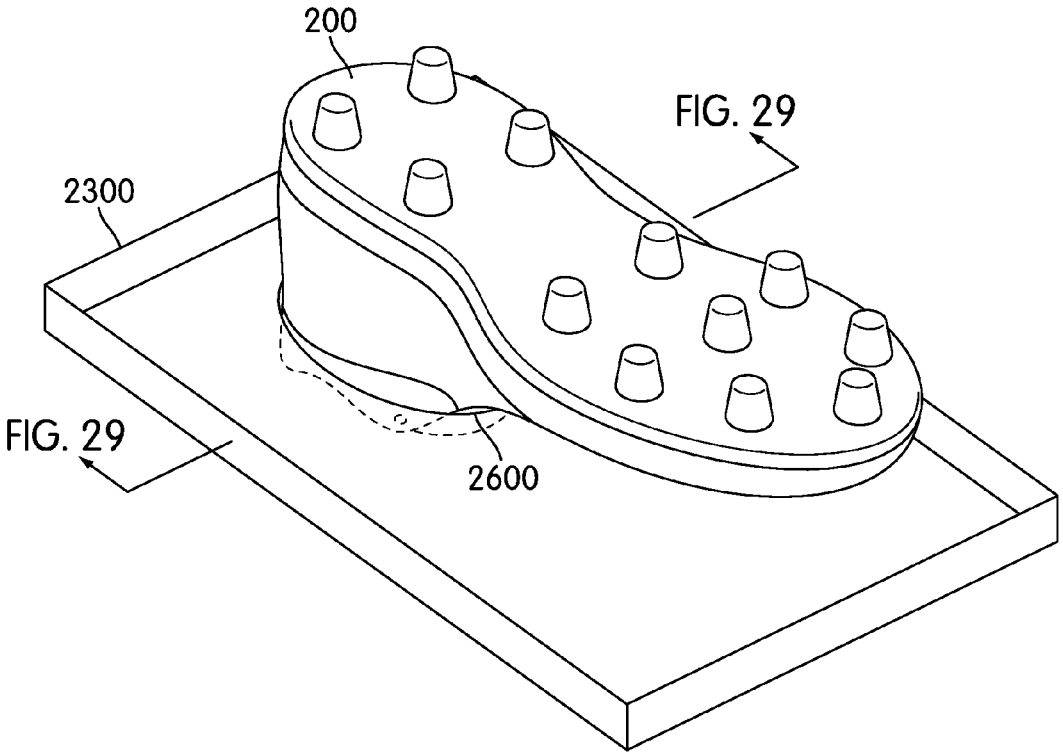
FIG. 28 is an isometric view of an exemplary embodiment of a lid having an article of footwear inserted into a hole in the lid.

Referring to FIGS. 26-28, a hole 2600 sized and dimensioned to fit a portion of an article of footwear may be formed by removal of predetermined removable area 2302. In one embodiment, predetermined removable area 2302 may be made removable by applying a force to punch out the removable area along the delineated outline 2500. As illustrated in FIG. 26, predetermined removable area 2302 is partially separated from container lid 2300. In some cases, predetermined removable area may be perforated. In other cases, predetermined removable area may be scored on one side. In other embodiments, predetermined removable area may be marked on either side of a container lid by dotted or dashed lines for removal by a customer. As illustrated in FIG. 27, predetermined removable area 2302 is fully removed from container lid 2300 to form hole 2600. Hole 2600 is sized and dimensioned to fit a portion of an article of footwear 200.

FIG. 28 illustrates an exemplary embodiment of a steaming apparatus provided as a container lid holding in place an article of footwear. In one embodiment, hole 2600 in container lid 2300 is configured to hold an article of footwear 200 in an inverted position. In other embodiments, the hole in the container lid may hold an article of footwear in any position.

Figure 29:
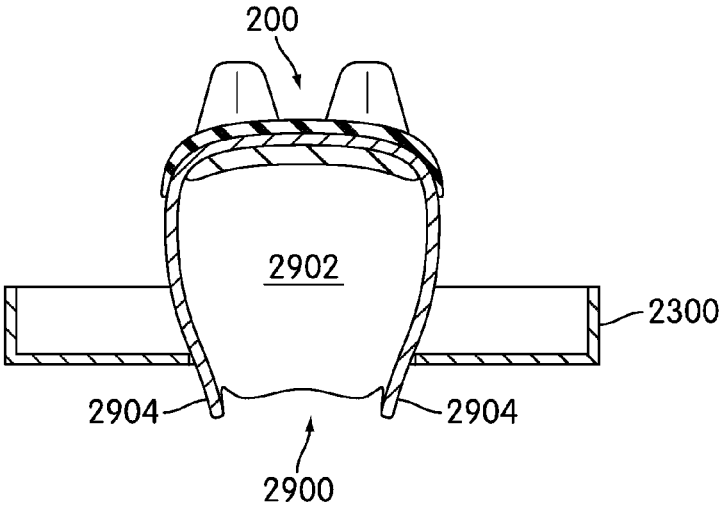
FIG. 29 is a cross sectional view of an exemplary embodiment of a lid having an article of footwear inserted into a hole in the lid.

FIG. 29 illustrates a cross-section detail of an embodiment of a steaming apparatus as a container lid holding in place an article of footwear. In this embodiment, article of footwear 200 includes throat 2900 configured to receive a foot of a wearer. Throat 2900 allows a foot to be inserted into an interior portion 2902 of article of footwear 200. In this embodiment, throat upper 2904 is a portion of article of footwear 200 that surrounds the throat 2900. In some embodiments, hole 2600 in container lid 2300 is sized and dimensioned to hold article of footwear 200 in an inverted position by contacting throat upper 2904 of article of footwear. In other embodiments, hole in container lid may be sized and dimensioned to hold a different portion of article of footwear.

Figure 30:
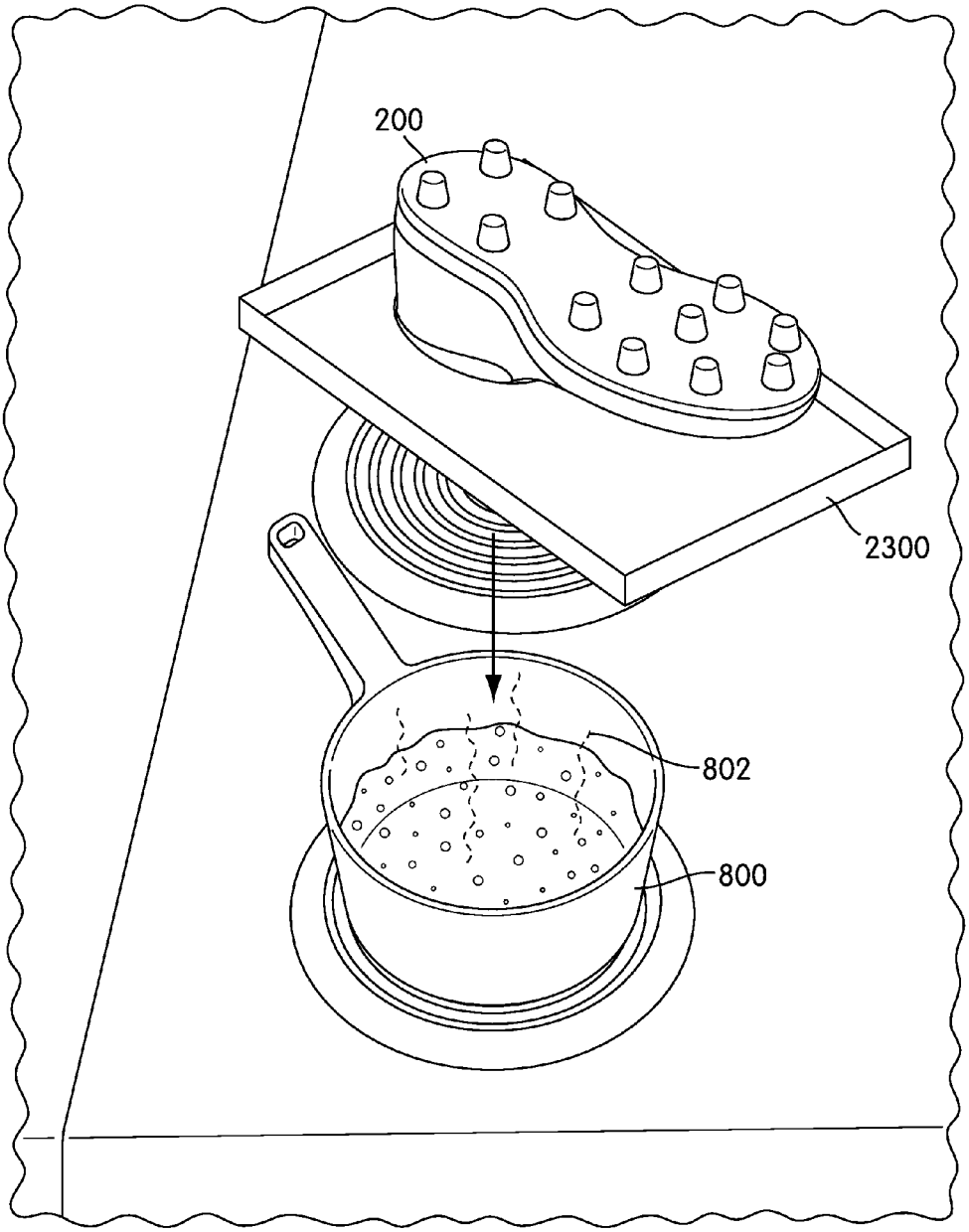
FIG. 30 is an isometric view of an exemplary embodiment of a lid having an article of footwear inserted into a hole in the lid disposed in proximity to a steam source.
Figure 31:
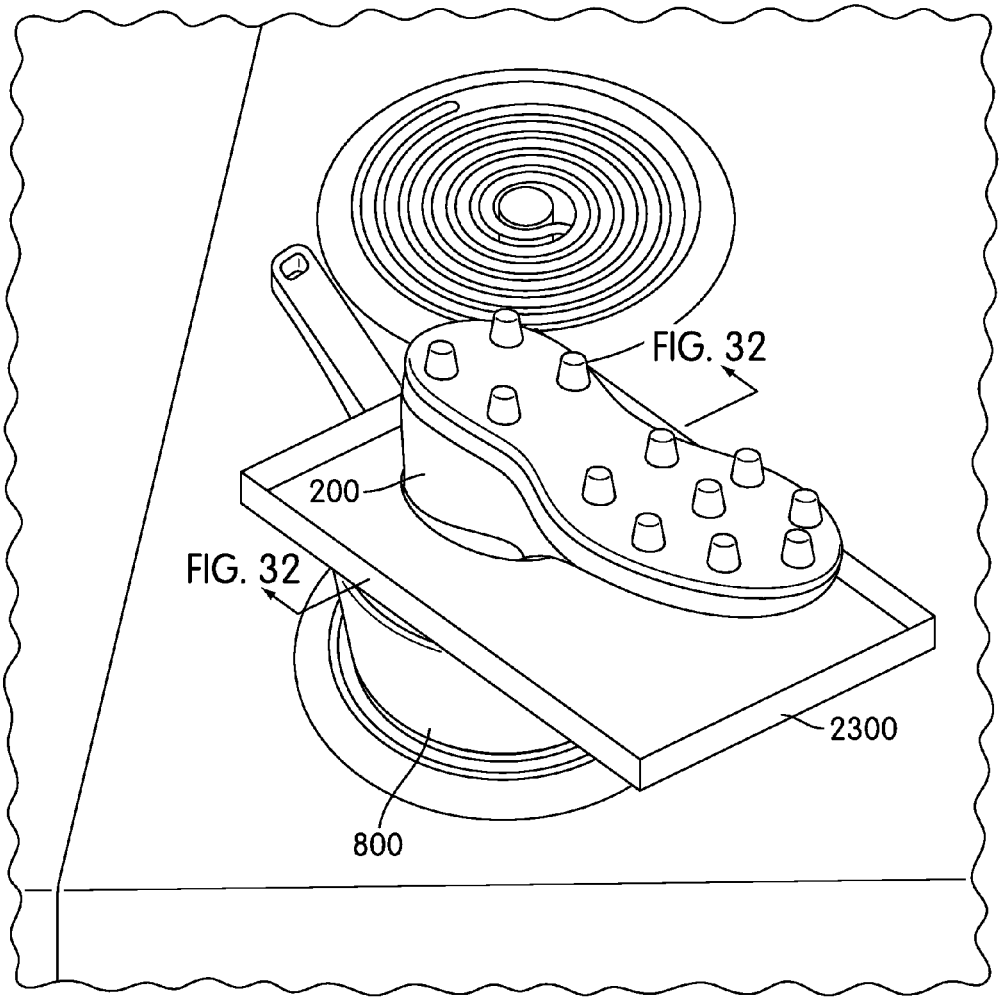
FIG. 31 is a side view of an embodiment of a lid having an article of footwear inserted into a hole in the lid subjected to steam.
Figure 32:
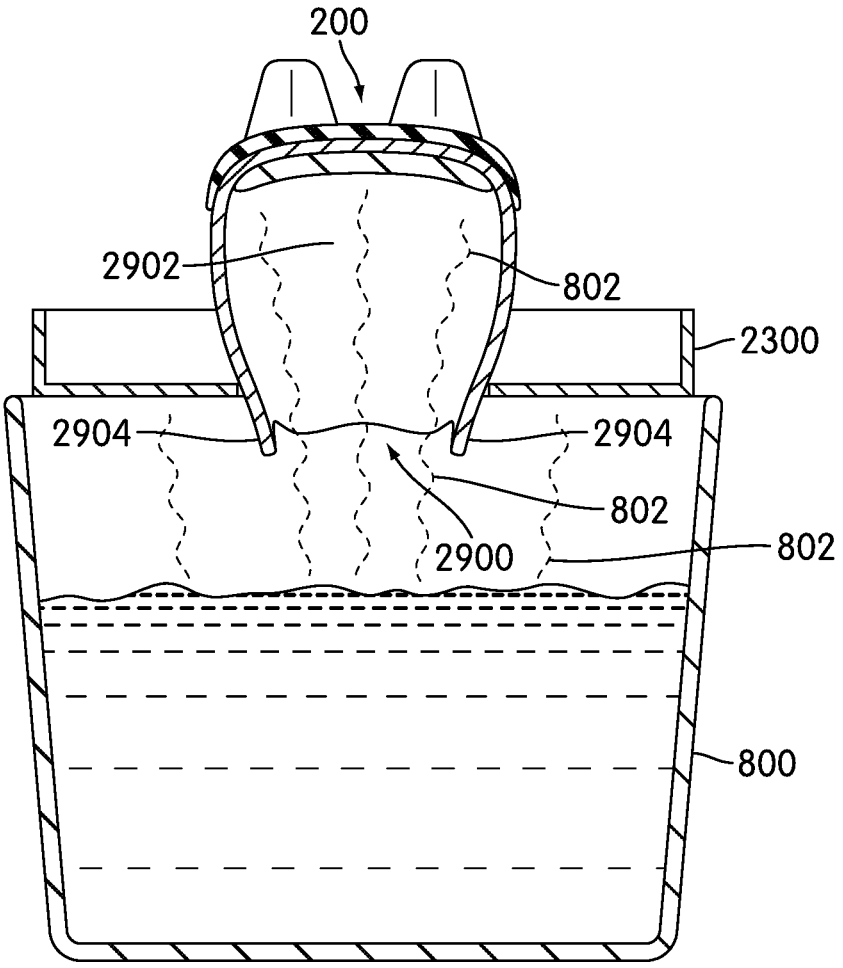
FIG. 32 is a cross sectional view of an embodiment of an article of footwear inserted into a hole in the lid being subjected to steam.

FIGS. 30-32 illustrate an exemplary embodiment of a steaming apparatus as a container lid containing an article of footwear subjected to a steam environment. Referring to FIG. 30, container lid 2300 containing an article of footwear 200 can be placed in proximity to a source of steam 802. As illustrated in FIG. 31, in this embodiment, container lid 2300 containing an article of footwear 200 is placed over a pot 800 containing boiling water. As illustrated in FIG. 32, steam 802 enters from pot 800 through throat 2900 and into the interior 2902 of article of footwear 200. Steam 802 moves around interior 2902 of article of footwear 200. Article of footwear can be subjected to steam environment. Article of footwear is then custom fitted as illustrated in FIGS. 11-13 and as discussed above.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A kit for custom fitting an article of footwear comprising:

a container; and a steam tray sized and dimensioned to receive an article of footwear;

wherein the steam tray includes:

a top portion; and a bottom portion containing holes;

wherein the bottom portion containing holes is disposed on an opposite side of the steam tray from the top portion; and wherein the top portion is a flexible sheet or film.

2. The kit of claim 1, further including an article of footwear.

3. The kit of claim 1, wherein the bottom portion is made of metal.

4. The kit of claim 1, wherein the top portion is transparent.

5. The kit of claim 1, wherein the top portion is releasably engaged to the bottom portion.

6. A method of providing a kit for custom fitting an article of footwear, the method comprising:

providing a kit including a container, a steam tray, and an article of footwear;

providing the steam tray inside the container;

providing the article of footwear within the container;

wherein the steam tray includes a top portion releasably engaged to a bottom portion containing holes; and wherein the top portion is a flexible sheet or film.

7. The method according to claim 6, further comprising the step of providing the article of footwear within the steam tray when the steam tray is disposed within the container.

8. The method according to claim 6, wherein the steam tray is sized and dimensioned to receive the article of footwear.

9. The method according to claim 6, wherein the steam tray is configured to subject the steam tray containing the article of footwear to a source of steam.

10. The method according to claim 6, further including a step of providing instructions for placing the article of footwear within the steam tray and subjecting the steam tray including the article of footwear to a source of steam.

11. A kit for custom fitting an article of footwear comprising:

a container;

a steam tray configured to fit inside the container; and an article of footwear;

wherein the steam tray is sized and dimensioned to receive the article of footwear inside the steam tray;

wherein the steam tray includes a top portion and a bottom portion containing holes;

wherein the bottom portion containing holes is disposed on an opposite side of the steam tray from the top portion; and wherein the top portion is a flexible sheet or film.

12. The kit according to claim 11, wherein the steam tray is provided inside the container, and wherein the article of footwear is provided inside the steam tray.

13. The kit according to claim 11, wherein the top portion is releasably engaged to the bottom portion.

14. The kit according to claim 11, wherein the bottom portion is metal.

15. The kit according to claim 11, wherein the bottom portion is plastic.

16. The kit according to claim 11, wherein the openings provide passage of steam to the interior of the steam tray.

17. The kit according to claim 11, further comprising a sleeve configured to hold the steam tray within the container.

18. The kit according to claim 11, wherein the article of footwear and the steam tray are packaged separately within the container.

* * * * *